United States Patent [19]

Maekawa et al.

[11] Patent Number: 4,988,085

[45] Date of Patent: Jan. 29, 1991

[54] RECORDED SHEET HANDLING APPARATUS

[75] Inventors: Yoshikazu Maekawa, Hachioji; Takeshi Muramatu, Sayama; Toshio Yokoyama, Kiyose; Shigemi Yukizane, Chofu, all of Japan

[73] Assignee: Konica Corporation, Tokyo, Japan

[21] Appl. No.: 307,455

[22] Filed: Feb. 8, 1989

[30] Foreign Application Priority Data

Feb. 9, 1988 [JP] Japan ..... 63-26698

[51] Int. Cl.[5] ..... B42B 2/00

[52] U.S. Cl. ..... 270/53; 270/58

[58] Field of Search ..... 270/37, 53, 58; 355/317, 324

[56] References Cited

U.S. PATENT DOCUMENTS

| | | | |
|---|---|---|---|
| 4,083,550 | 4/1978 | Pal | 270/53 |
| 4,552,497 | 11/1985 | Kockler | 270/53 |
| 4,763,167 | 8/1988 | Watanabe | 355/324 |

FOREIGN PATENT DOCUMENTS

| | | | |
|---|---|---|---|
| 61-84662 | 4/1986 | Japan . | |
| 61-94180 | 5/1986 | Japan . | |
| 62-32472 | 2/1987 | Japan | 355/324 |
| 63-109448 | 5/1988 | Japan | 355/324 |
| 63-117870 | 5/1988 | Japan | 270/53 |

OTHER PUBLICATIONS

Publication from the Institute of Electrophotography of Japan, vol. 24, No. 3, 1985, pp. 188–194.

*Primary Examiner*—Carl D. Price
*Assistant Examiner*—Therese M. Newholm
*Attorney, Agent, or Firm*—Finnegan, Henderson, Farabow, Garrett, and Dunner

[57] ABSTRACT

A recorded sheet handling apparatus includes a holding unit for temporarily holding a set of recorded sheets externally fed one by one, a pair of side plates for moving the recorded sheets by a predetermined distance in a direction perpendicular to a recorded sheet convey direction prior to stapling when a size of the recorded sheets is a predetermined size, a punching machine and staplers for punching or stapling the set of recorded sheets while the sheets are held by the holding unit, and a conveying unit for conveying the punched or stapled copied sheets so as to exhaust the sheets.

5 Claims, 15 Drawing Sheets

60
F
50
a
b
H1
H2
H3
ℓ

RECORDED SHEET HANDLING APPARATUS

BACKGROUND OF THE INVENTION

1. FIELD OF THE INVENTION

The present invention relates to a recorded sheet handling apparatus suitably used together with a recording apparatus such as a copying machine.

2. DESCRIPTION OF THE PRIOR ART

In recent years, conventional recording apparatuses such as printers and facsimile systems in addition to copying machines have been used in various fields. In these recording apparatuses, multi-functional, high-speed features are required for the copying machines.

When conference data and distribution data are to be prepared in the form of a recorded document by a recording apparatus such as a copying machine, the recorded sheets must be aligned, folded, punched, or stapled. Many attempts have been made to automate these operations so as to improve total copying efficiency. For this purpose, a sorter for sorting the copied sheets, an automatic punching apparatus, an automatic folding machine, an automatic gathering machine, and a handling apparatus as a combination of these apparatuses and machines have been proposed, as described in Japanese Unexamined Patent Publication (Kokai) No. 61-94180 and 61-84662 and a publication from the Institute of Electrophotography of Japan, Vol. 24, No. 3, 1985, PP. 188–194.

The recorded sheets are often stapled or filed for later use. However, a handling apparatus for punching and stapling the recorded sheets has never been proposed.

The present inventors proposed a recorded sheet handling apparatus in U.S. patent application Ser. No. 07/146,569 filed on Jan. 21, 1988. This apparatus comprises an intermediate holding unit for sequentially stacking a set of recorded sheets which are externally supplied one by one, a handling unit for selectively punching or stapling at a holding position the set of recorded sheets held in the intermediate holding unit, a storage unit for storing handled recorded sheets, a first convey means for conveying the non-handled recorded sheets to the intermediate holding unit, and a second convey means for conveying the handled sheets to the storage unit. When this handling apparatus is used together with a recording apparatus such as an electrophotographic copying machine, a set of recorded sheets can be automatically punched and stapled to conveniently prepare conferential and distributional references.

When three holes are punched in a sheet having a size of 8.5" × 11" used in U.S.A. (this sheet will be referred to as an F4 size hereinafter) and the punched sheets are stapled, the punching positions undesirably come close to the stapling positions. Therefore, it is difficult to optimally determine the positions of staplers and a punching machine.

SUMMARY OF THE INVENTION

It is an object of the present invention to provide a recorded sheet handling apparatus which does not present punching and stapling problems even if punched holes are very close to stapling positions. In order to achieve the above object, the recorded sheets can be moved by a predetermined distance in a direction perpendicular to a convey direction prior to stapling of the recorded sheets.

DETAILED DESCRIPTION OF THE PREFERRED EMBODIMENTS

The present invention will be described in detail with reference to the accompanying drawings.

An illustrated handling apparatus is a copied sheet handling apparatus used together with a copying machine. As shown in the schematic view of FIG. 1, a copied sheet handling apparatus 1 is coupled to a copying machine 2 at a position indicated by a broken line E.

Prior to a description of the copied sheet handling apparatus 1 as the characteristic feature of the present invention, the copying machine 2 will be briefly described.

Since the copied sheet handling apparatus which can employ the present invention must punch or staple a set of copied sheets obtained from a plurality of originals constituting the document (e.g., five pages from page 1 to page 5 of a book), the copying machine must have a function for sequentially, repeatedly copying the plurality of originals. In this sense, the copying machine must have a recirculation type automatic document feeder (to be referred to as an RDF hereinafter).

Figure 1:
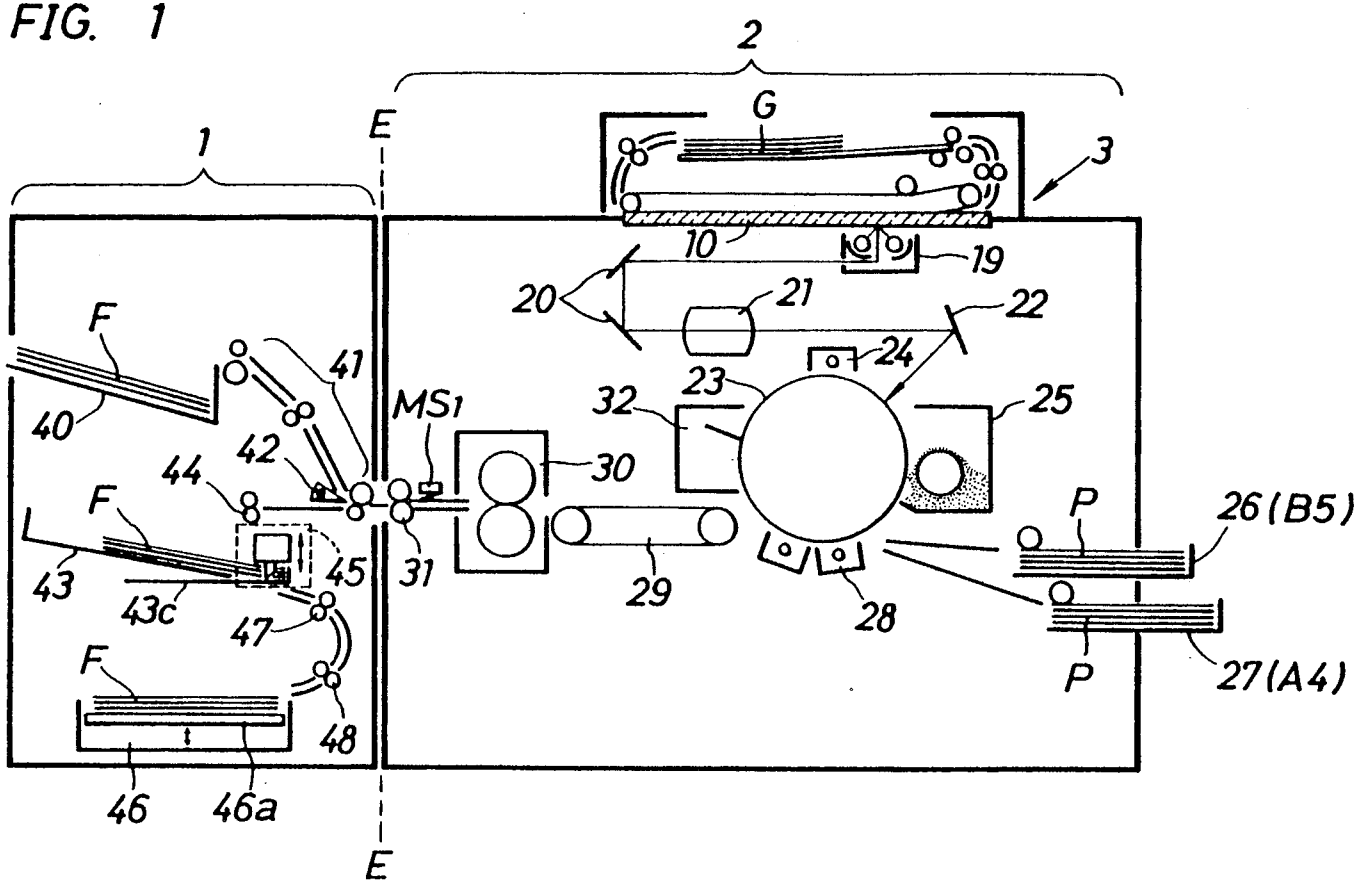
FIG. 1 is a schematic view of a copied sheet handling apparatus as a recorded sheet handling apparatus shown together with a copying machine.

As is apparent from FIG. 1, an RDF 3 is attached to the upper portion of the copying machine 2. Document originals fed one by one by the RDF 3 are copied by the conventional electrophotographic processes. The structures and functions of the copying machine 2 and the RDF 3 are known to those skilled in the art and will be briefly described.

Figure 2:
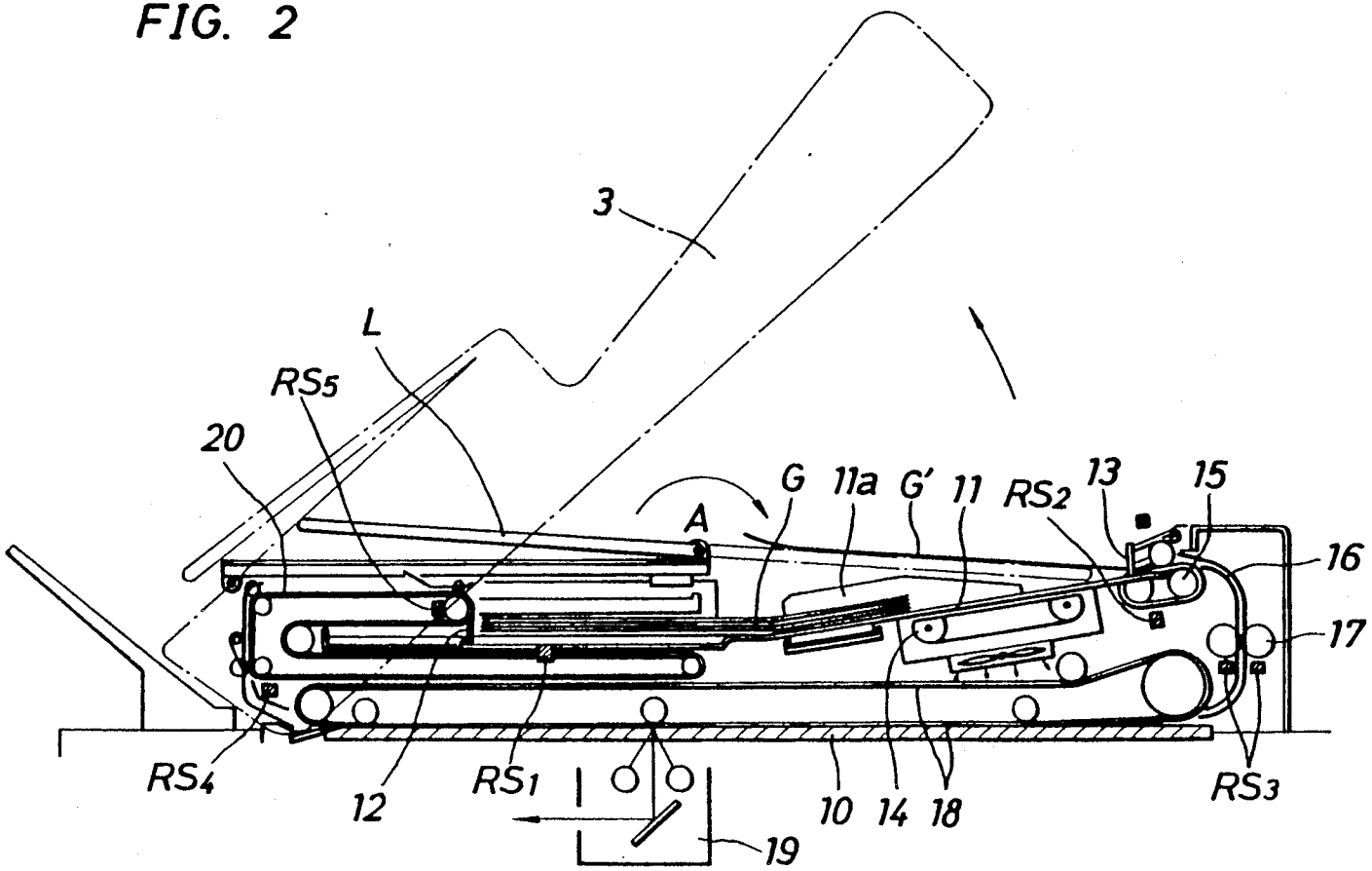
FIG. 2 is a schematic view of a recirculation type automatic document feeder (RDF) constituting part of the copying machine.

The RDF 3 is mounted on a glass plate 10 arranged on the upper surface of the copying machine 2. As shown in FIG. 2, a plurality of originals G to be copied are placed on a document table 11 while the originals G face upward. In this case, the first page, the second page, . . . are stacked from the top. A document sensor $RS_1$ detects that the originals of the document are placed on the document table 11. When an operator depresses a copy button arranged in the operation panel of the copying machine 2, a trailing end regulating plate 12 of the RDF 3 is moved forward, and the document constituted by the originals G is entirely moved forward (the right direction in FIG. 1). At the same time, a gate 13 located on the document feed path is moved upward. The originals G pass through the gate 13 and are slightly fed to a predetermined position. When a document distal end detection sensor $RS_2$ detects the originals G, the trailing end regulating plate 12 is stopped and the gate 13 is moved downward. The trailing end regulating plate 12 is then moved backward.

When a document feed signal is output from the copying machine 2 at a predetermined timing, semi-circular feed rollers 14 are rotated by one revolution and at the same time double feed preventive rollers 15 are rotated to feed only the lowermost original of the document. The fed original is fed by document feed rollers 17 along a guide plate 16. The leading end of the original is detected by a timing sensor $RS_3$ and is transferred to a conveyor belt 18. The original travels on the glass plate 10 of the copying machine 2 at a predetermined speed. An optical system 19 including a document illumination lamp and a reflecting mirror is arranged below the glass plate 10. The original is exposed by the optical system 19 while the original is being conveyed. When the leading end detection signal is sent from the timing sensor $RS_3$ to the copying machine 2, a transfer sheet is fed in the copying machine 2. The original exposed with light is detected by a discharge sensor $RS_4$ and is conveyed by another conveyor belt 20. The discharged original is stacked on the remaining originals on the document table 11. Discharge of the last original is detected by a recirculation paper sensor $RS_5$. Jamming during original feeding is detected by detection timing signals from the sensors $RS_3$ and $RS_4$.

Feeding of the second original of the document is started when the trailing end of the first original is detected by the timing sensor $RS_3$.

When the third original, the fourth original, . . . and the last original are exposed with light emitted from the optical system in the copying machine, the leading end detection sensor $RS_2$ detects that no originals of the document are left, thereby completing feeding of all originals of each document.

If five sets of copies are to be prepared from one document consisting of a plurality of originals, the originals are fed from the last page to the first page by the RDF. The document feed cycle is repeated by the number corresponding to the desired sets of copies.

In synchronism with the above operations of the RDF 3, the following electrophotographic operations are performed in the copying machine 2.

When an original of the document passing along the glass plate 10 of the copying machine 2 at a constant speed is exposed with the optical system 19, light reflected by the original is incident on a photosensitive body 23 through a mirror 20, a lens 21, and a mirror 22. Since the surface of the photosensitive body 23 is uniformly charged by a charging unit 24, incidence of the light reflected by the original allows formation of a latent image. The latent image is developed by a developing unit 25 and a visual or toner image is obtained. The visual image is transferred by a transfer unit 28 to the transfer sheet P fed from one of paper cassettes 26 and 27.

The transfer sheet having the visual image thereon is separated from the photosensitive body 23 by a separating unit and is conveyed by a conveyor belt 29. The conveyed sheet is then fixed by a fixing unit 30. The sheet is then discharged from the copying machine by a discharge roller 31. Reference numeral 32 denotes a cleaning unit for removing residual toner particles from the surface of the photosensitive body 23 after the transfer sheet is separated from the photosensitive body.

The copying machine is exemplified by the most simple one for performing one-sided copying using a one-sided original. However, the recorded sheet handling apparatus according to the present invention may be combined with a copying machine for performing both-sided copying using a one-sided original or one- or both-sided copying using a both-sided original. In order to perform the above copying operations, each original must be reversed or each transfer sheet must be reversed. The copying machine 2 and the RDF 3 must have transfer sheet and document original reversing mechanisms, respectively. These mechanisms are known to those skilled in the art, and a detailed description thereof will be omitted since these mechanisms are out of scope of the present invention.

As shown in FIG. 1, the copied sheet handling apparatus 1 according to the present invention comprises: convey rollers 41 for delivering sheets F copied and discharged from the copying machine 2 to a discharge tray 40 without punching or stapling the copied sheets F; convey rollers 44 for conveying the copied sheets F to an intermediate tray 43 called a stacker so as to punch or staple the copied sheets F after a path switching gate 42 is switched; a handling unit 45 for punching or stapling the copied sheets F serving as one set of document stacked on the stacker 43; and convey rollers 47 and 48 for finally conveying punched or stapled sheets F to a storage tray 46.

The handling unit 45 comprises a punching machine and two staplers arranged at two sides of the punching machine. As indicated by arrow A in FIG. 3, the handling unit 45 can be pulled toward the operator (i.e., an upward direction perpendicular to the drawing surface of FIG. 1) due to the following reasons. The punching dust as a result of punching must be easily removed, the staplers must be easily replenished with staples, and the clogging staples must be easily removed.

Figure 9:
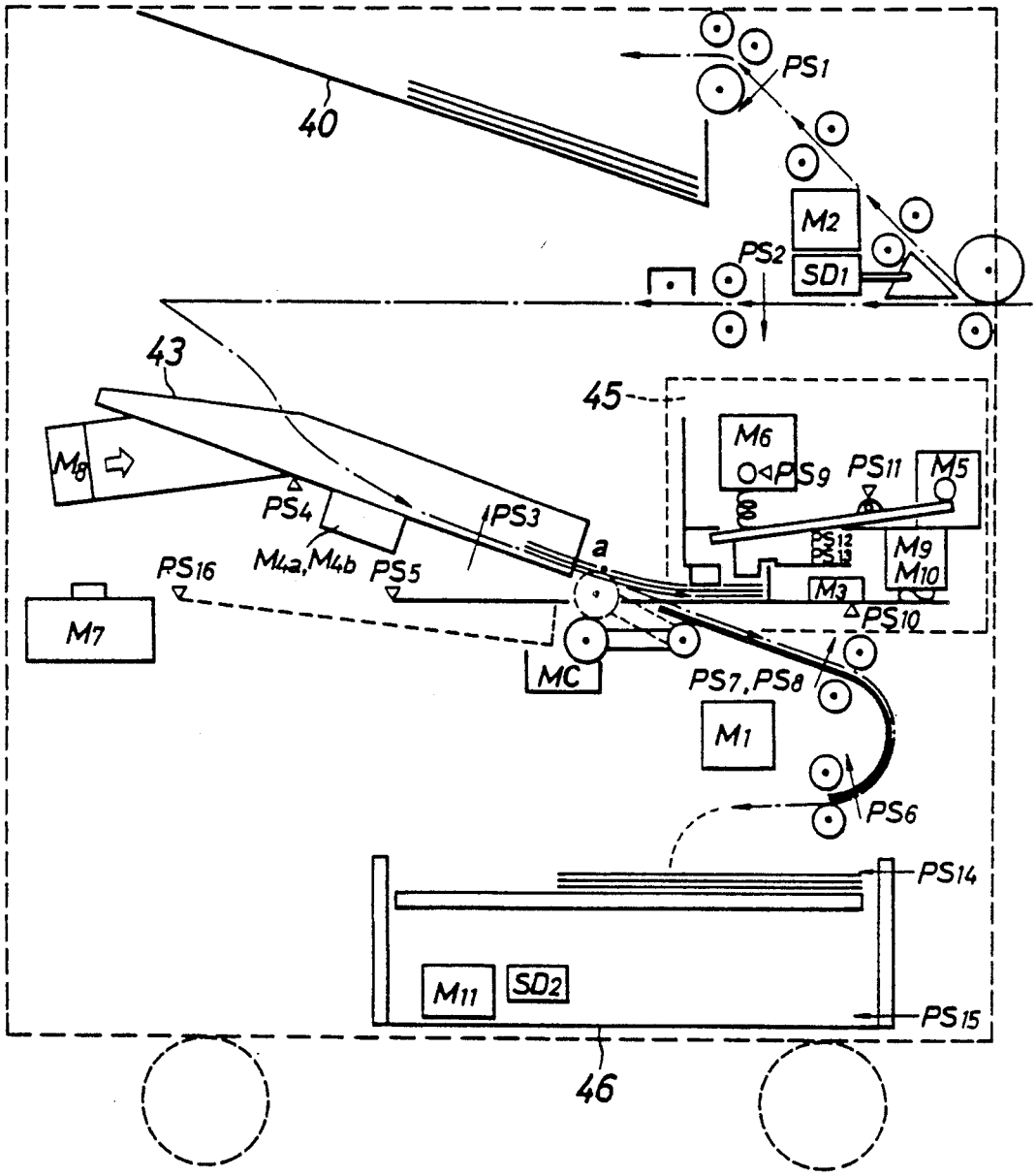
FIG. 9 is a view showing the layout of motors, sensors, and solenoids in the copying sheet recording apparatus.

The storage tray 46 is arranged such that its base 46*a* for supporting the handled sheets F can be vertically moved. The base 46*a* can be vertically moved by a tray lifting motor $M_{11}$ (FIG. 9). When the height of the sheets F on the base 46*a* exceeds a predetermined value, it is detected by a tray upper limit sensor $PS_{14}$. The lower limit of the position of the tray 46 is detected by a tray lower limit sensor $PS_{15}$. The tray upper limit sensor $PS_{14}$ detects that the position of the tray 46*a* exceeds the upper limit position. However, the tray lower limit sensor $PS_{15}$ detects that the tray position is lower than the lower limit position. The base 46a is vertically moved by the tray lifting motor $M_{11}$. In this case, a solenoid $SD_2$ is operated to brake the base 46a so as not to further move the base 46a downward due to the weight of the handled sheets F on the base 46a.

The structure of the copied sheet handling apparatus employing the handling unit described above will be described in detail below.

Figure 3:
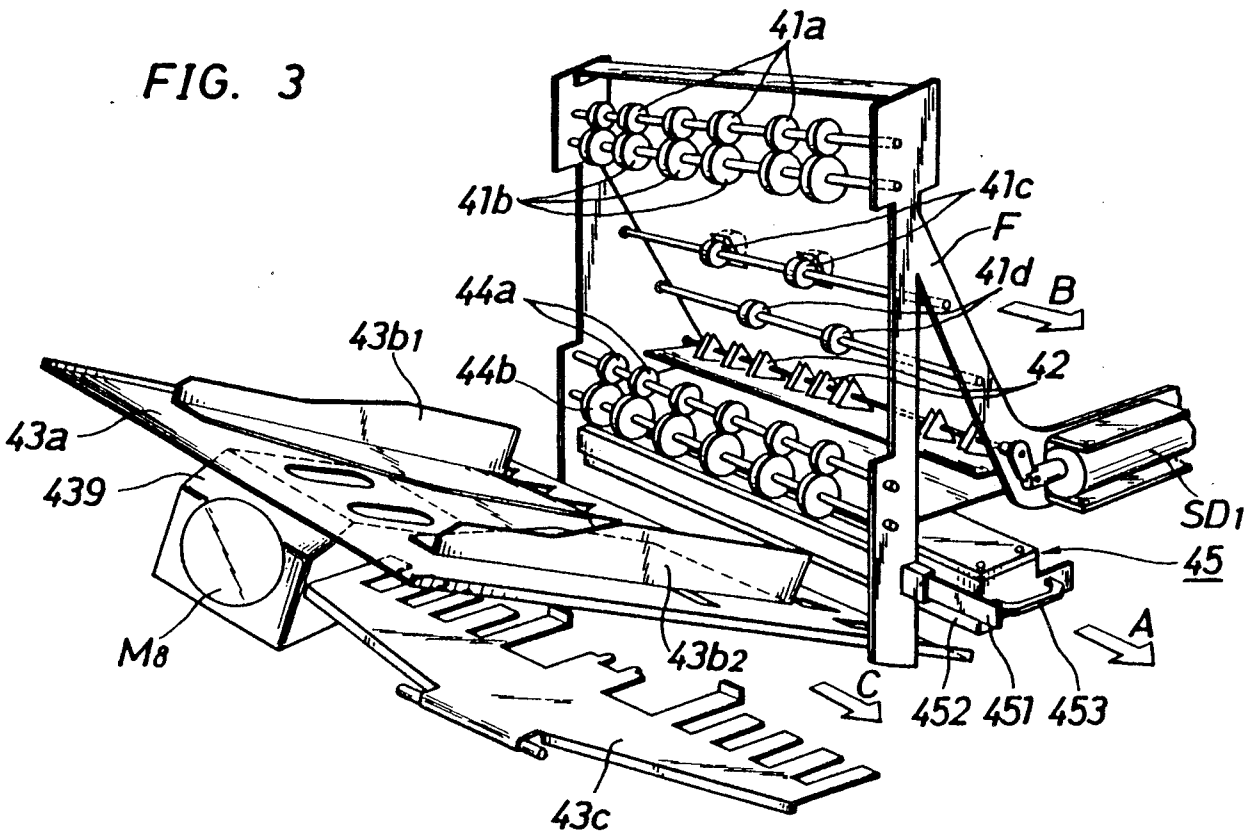
FIG. 3 is a perspective view of the main part of the recorded sheet handling apparatus according to the present invention.

FIG. 3 is a perspective view showing the main part of the copied sheet handling apparatus. Rollers 41a, 41b, 41c, and 41d constitute convey rollers 41 together with other rollers (not shown). The path switching gate 42 is driven by a solenoid $SD_1$. When the solenoid $SD_1$ is not energized, the path switching gate 42 is located at the first position where the copied sheets are conveyed to the discharge tray 40. However, when the solenoid $SD_1$ is energized, the path switching gate 42 is switched to the second position where the copied sheets are conveyed to the stacker 43. Rollers 44a and 44b constitute convey rollers 44.

The stacker 43 comprises an inclined plate 43a a pair of side plates 43b$_1$ and 43b$_2$ slidably mounted on the upper surface of the inclined plate 43a so as to adjust the distance between the side plates 43b$_1$ and 43b$_2$, and copied sheet stopper 43c located below the inclined plate 43a so as to move back and forth.

Figure 4:
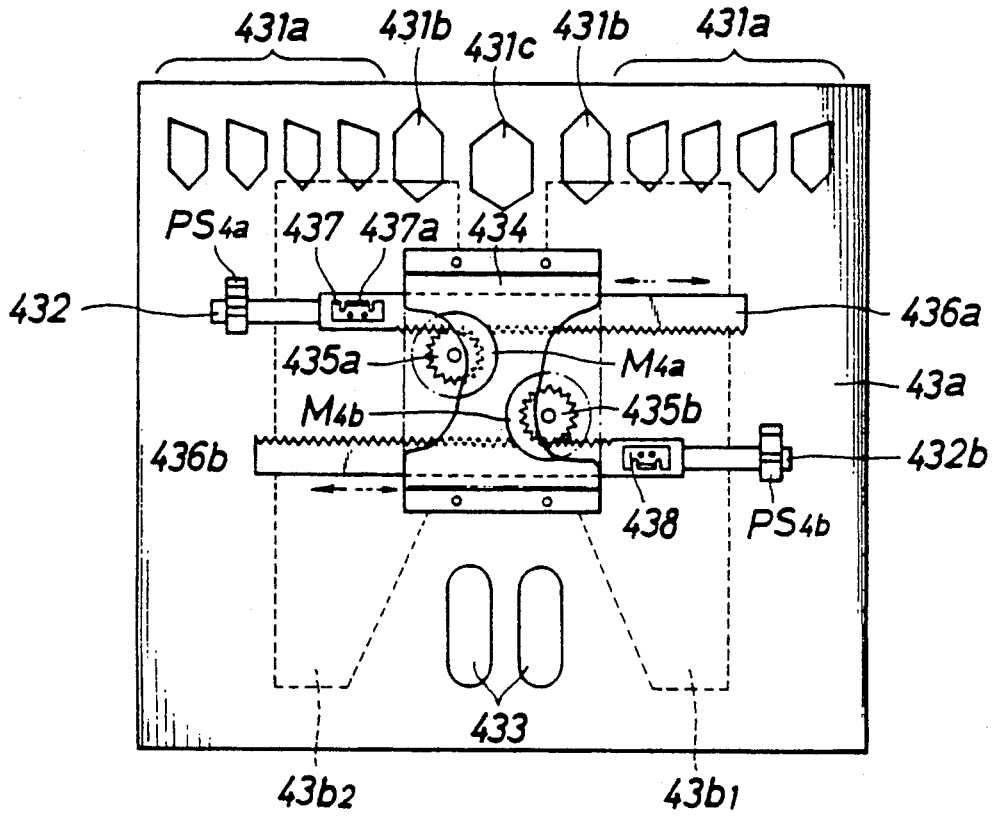
FIG. 4 is a rear view of an inclined plate of the recorded sheet handling apparatus according to the present invention.

The inclined plate 43a has a plurality of openings 431a, 431b, and 431c formed near the front end (when viewed from the rear side of the inclined plate, as shown in FIG. 4). Two elongated slots 432a and 432b are formed at the central portion of the inclined plate 43a and extend along the transverse direction. Vent holes 433 are formed near the lower end of the inclined plate 43a.

Motors $M_{4a}$ and $M_{4b}$ are mounted on the rear surface of the inclined plate 43a through a support plate 434. Gears 435a and 435b are respectively fixed to the rotating shafts of the motors (side plate distance adjusting motors) $M_{4a}$ and $M_{4b}$. Two slidable members 436a and 436b having toothed portions on inner sides thereof are meshed with the gears 435a and 435b and are parallel to each other. The slidable members 436a and 436b are fixed on the side plates 43b$_1$ and 43b$_2$ (located on the upper surface of the inclined plate 43a) through metal pieces 437 and 438, respectively. Elongated projections are formed on the slidable plates 436a and 436b and loosely fitted in the slots 432a and 432b, respectively. Photosensors (side plate home position sensors) $PS_{4a}$ and $PS_{4b}$ are arranged near the end of the slot 432a to detect the reference positions (home positions) of the side plates 43b$_1$ and 43b$_2$. The photosensors $PS_{4a}$ and $PS_{4b}$ detect that an upright portion 437a of the metal piece 437 and an upright portion 438a of the metal piece 438 shield light, thereby detecting the home positions. With the above arrangement, when the side plate distance adjusting motors $M_{4a}$ and $M_{4b}$ are rotated through a predetermined angle in the forward or reverse direction, the slidable members 436a and 436b are moved in a direction indicated by the solid or broken line by a predetermined distance. As a result, the slide plates 43b$_1$ and 43b$_2$ are separated from each other or come close to each other. Such movement of the side plates 43b$_1$ and 43b$_2$ are used for both sheet width regulation and sheet alignment.

As shown in FIG. 3, a motor $M_8$ for driving a ventilation fan and a duct 439 are mounted near the vent holes 433 on the lower surface of the inclined plate 43a.

The stopper 43c will be described below.

As shown in FIG. 3, the stopper 43c comprises a plate member 443 consisting of a plurality of straight projections 440 extending forward, two L-shaped projections 441 having upright portions 441a, and a wide central projection 442. Pins 444 extend from the right and left ends of the plate member 443. The pins 444 are engaged with grooves 445a formed in the side surfaces of plastic guides 445 (only the left guide is illustrated) fixed on the frame of the apparatus, respectively. A drive rod 446 extending backward is mounted at the central portion of the plate member 443. Teeth 446a formed on the longitudinal side of the drive rod 446 are meshed with a pinion 447. The pinion 447 is driven by a motor (stopper drive motor) $M_7$ in the forward or reverse direction so that the drive rod 446 is guided by a roller 448 and a guide roll 449 and is linearly moved in the direction of an arrow. When the rod 447 is linearly moved, the pins 444 are guided along the grooves 445a of the guides 445 and are reciprocally moved in the directions of a double-headed hollow arrow.

Assume that the projections 4440, 441, and 442 of the plate member 443 of the stopper 43c are located at positions respectively corresponding to the openings 431a, 431b, and 431c. When the plate member 443 is moved forward, the projections 440, 441, 442 pass through the corresponding openings 431a to 431c, and the stopper 43c is located above the inclined plate 43c. In the forward position of the plate member 443, the projections 441 extend upward from the inclined plate 43a through the openings 431b, and the upright portions 41a serve as stopper elements for stopping the copied sheets sliding along the inclined plate 43a to a predetermined position.

The handling unit 45 comprises a punching machine and two stapling machines (staplers) located at both sides of the punching machine. These components of the handling unit 45 are mounted in a frame 45b which can be pulled along a guide rail 45a (in a direction indicated by hollow arrow A). The main part of the handling unit 45 is illustrated in FIG. 6.

Figure 6:
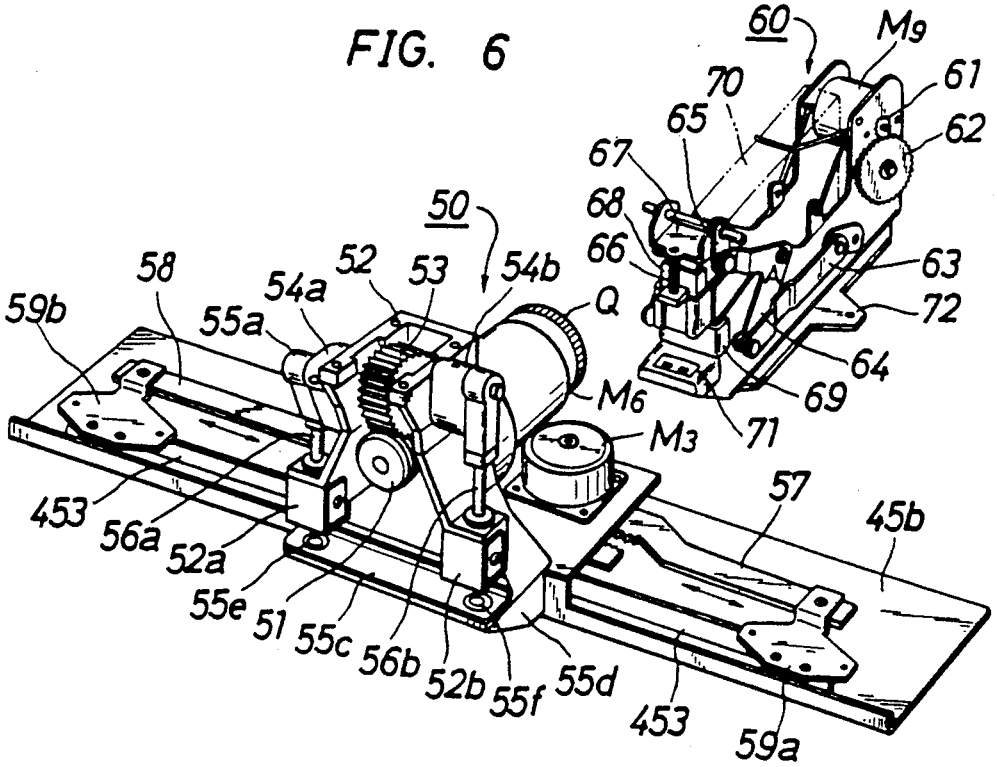
FIG. 6 is a perspective view showing a handling unit after a stapler is removed.

As is apparent from FIG. 6, a punching machine 50 is fixed at the central portion of a frame 45b, and the two staplers are movably arranged at both sides of the punching machine 50. One of the staplers is removed from the frame 45b, and the removed stapler is represented by reference numeral 60.

The punching machine 50 comprises a worm gear 51 which is reversibly rotatable by a motor (punch drive motor) $M_6$, a gear 53 supported by a holder 52 and meshed with the worm gear 51, two crank members 54a and 54b located at different angular positions at both sides of the gear 53, and swingable members 55a and 55b pivotally coupled to the crank members 54a and 54 b. Punching pins 56a and 56b extending from the lower ends of the swingable members 55a and 55b are received by pin guides 52a and 52b integrally formed with the holder 52, respectively. Upon rotation of the motor $M_6$, the punching pins 56a and 56b are vertically moved through the worm gear 51, the gear 53, the crank members 54a and 54b, and the swingable members 55a and 55b. The punching pins 56a and 56b are inserted into or removed from dies 55e and 55f to punch sheets (a plurality of copied sheets) placed on a horizontal base 55c. The distal ends of the punching pins 56a and 56b are inserted in the pin guides 52a and 52b at positions slightly lower than the uppermost positions. Therefore, the punched sheet pieces can be properly removed from the pins. The punching dust is stored in a case detachably attached to the lower side of the horizontal table 55*c*.

Two slidable members 57 and 58 are parallel to each other on the frame 45 of the handling unit 45 and have opposite toothed sides. A gear (not shown) meshed with the teeth of the slidable members 57 and 58 are interposed therebetween. This gear is rotated by a motor (stapler moving motor) $M_3$ in the forward or reverse direction. Fixing plates 59*a* and 59*b* are fixed near ends of the slidable members 57 and 58 to fix the staplers. When the slidable members 57 and 58 are moved in the direction of the arrow upon rotation of the motor $M_3$, the fixing plates 59*a* and 59*b* are moved accordingly along a guide rail 453 formed on the frame 45*b*. Therefore, the staplers 60 fixed on the fixing plates 59*a* and 59*b* are moved accordingly.

In the stapler 60, rotation of the motor (stapler drive motor) $M_9$ is transmitted to the crank member through the gears 61 and 62, and a lever 63 can be slowly and reciprocally moved. Upon reciprocal movement of the lever 63, a V-shaped lever 64 is pivoted about a pivot pin A to pivot the lever 65. When the lever 65 is moved downward, a spring 66 is compressed through a U-shaped press member 67, and a thin plate 68 is moved along a guide 69. As a result, one of the staples in a cartridge 70 is separated by the thin plate 68 and pushed outside. Therefore, the sheets (a plurality of copied sheets) placed on a table 71 are stapled.

The staplers 60 can be mounted on the frame 45*a* such that mounting plates 72 at the bottom surfaces of the staplers 60 are respectively fixed to the fixing plates 59*a* and 59*b*.

The handling unit 45 comprises the single frame 45*b* on which the punching machine 50 is located at the center and the samplers 60 are located at both sides of the punching machine 50. The entire unit 45 can be pulled forward by a handle 453 (FIG. 3) in a direction indicated by hollow arrow A. When punching dust clogs in the case 55*d* or staples from the staplers 60 clog therein, the operator pulls the handle 453 to remove the handling unit 45 and can immediately remove the punching dust or staples.

Figure 7:
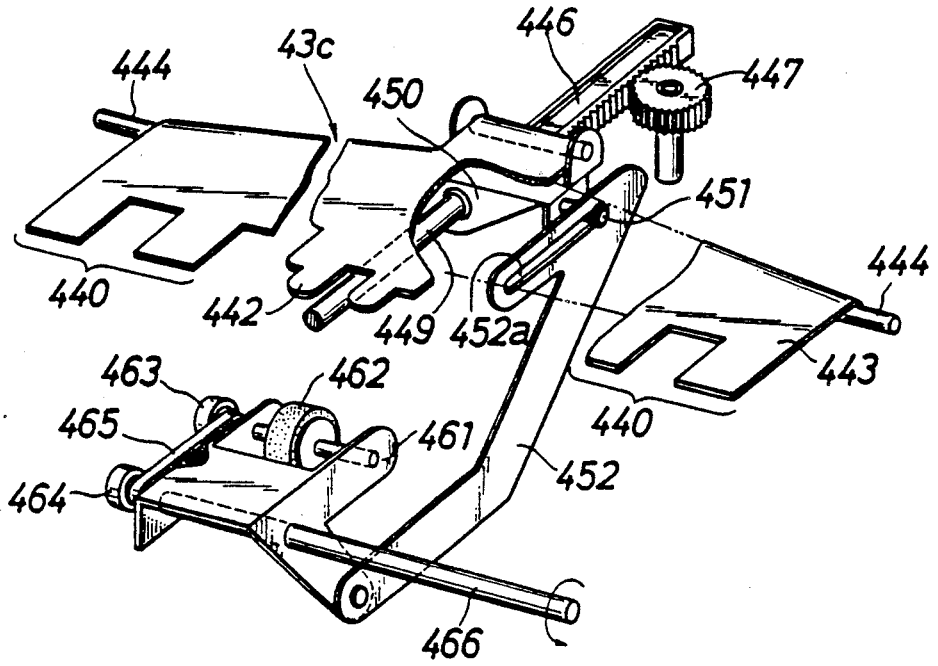
FIG. 7 is a perspective view of a discharge mechanism of handled copied sheets.

FIG. 7 shows a feed mechanism for feeding the punched or stapled sheets to the next conveying means in the stacker 43 serving as the main part of the present invention.

A U-shaped support plate 450 is mounted at the lower central portion of a plate member 443 of the stacker 43 to support a guide rod 449. A pin 451 horizontally extends from the side surface of the support plate 450. The pin 451 is engaged with a slot 452*a* formed at one end of a bent lever 452. One end of a V-shaped lever 461 of a roller unit 460 is loosely coupled to the other end of the bent lever 452. A feed roller 462 is rotatably mounted at the center of the roller unit 460 attached to the other end of the bent lever 452. The feed roller 462 is rotated by a shaft 466 rotated by a motor (copied sheet convey motor) $M_1$ through a belt 465 looped between two rollers 463 and 464. In the stacking mode, the stopper 43*c* is engaged with the openings 431*a*, 431*b*, and 431*c* to cause the upright portions 441*a* of the projections 441 to stop the copied sheets. When the sheets are to be conveyed, the stopper 43*c* is moved downward, and the roller 462 extends above the inclined plate 43*a*, thereby feeding the handled sheets.

Figure 8:
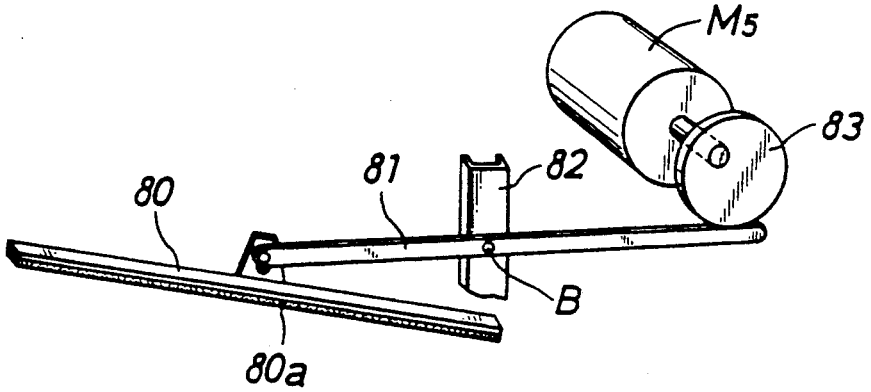
FIG. 8 is a perspective view of a mechanism for driving a paper press bar.

FIG. 8 shows a paper bar and its driving mechanism wherein the sheet portions subjected to punching or stapling are pressed prior to punching or stapling of the sheets placed on the stacker 43.

The paper press bar 80 comprises an elongated metal rod and a sponge 80*a* attached to the lower surface thereof. The paper press bar 80 is slidably suspended by a bar 81 at the central elongated hole. The bar 81 is loosely fixed to a frame 82 such that the bar 81 can be swung like a seesaw about a point B. One end of the bar 81 is in contact with the surface of an eccentric cam 83 rotated by a motor (paper press bar drive motor) $M_5$.

Upon rotation of the motor $M_5$, the other end of the bar 81 is vertically moved by the eccentric cam 83. When the motor $M_5$ is rotated in synchronism with punching or stapling, the copied sheets prior to stapling can be pressed by the weight of the paper press lever 80.

FIG. 9 shows the layout of the motors, the sensors, and the solenoids which are arranged in the copied sheet handling apparatus. Some of these have already described, but the functions of all of them will be summarized below.

| Motor | Function |
|---|---|
| Copied Sheet Convey Motor $M_1$ | Convey the handled sheets from the stacker 43 and to convey them to the tray 46 |
| Copied Sheet Convey Motor $M_2$ | Convey the copied sheets from the copying machine 2 to the tray 40 or the stacker 43 |
| Stapler Moving Motor $M_3$ | Adjust positions of the staplers 60; this motor is preferably a stepping motor |
| Side Plate Distance Adjusting Motors $M_{4a}$, $M_{4b}$ | Adjust the distance between the side plates of the stacker 43 in accordance with the paper size; these motors are preferably stepping motors |
| Paper Press Drive Motor $M_5$ | Move the paper press bar 80 vertically in synchronism with punching and/or stapling |
| Punch Drive Motor $M_6$ | Move the punching pins 56a and 56b in the punching machine 60 vertically |
| Stopper Drive Motor $M_7$ | Move the plate member 443 in the stopper 43c reciprocally |
| Stacker Fan Drive Motor $M_8$ | Drive the fan for supplying air to the upper surface of the inclined plate 43a in the stacker 43 |
| **Motor** | **Function** |
| Stapler Drive Motors $M_9$, $M_{10}$ | Press staples of the staplers |
| Tray Lifting Motor $M_{11}$ | Move vertically the base 46a which supports the punched or stapled copied sheets |
| **Sensor** | **Function** |
| Discharge Sensor $PS_1$ | Detect that the copied sheets are delivered to the tray 40 |
| Stacker Discharge Sensor $PS_2$ | Detect that the copied sheets are delivered onto the stacker 43 |
| Stacker Empty Sensor $PS_3$ | Detect that the stacker 43 is empty |
| Side plate Home Position Sensors $PS_{4a}$, $PS_{4b}$ | Detect the home positions of the side plates $43b_1$ and $43b_2$ |
| Stopper ON Sensor $PS_5$ | Detect that the stopper 43c reaches the predetermined stopper position |
| Tray Discharge Sensor $PS_6$ | Detect that the punched |

-continued

| Motor | Function |
|---|---|
| | and/or stapled copied sheets are discharged onto the tray 46 |
| Temporary Stop Sensors $PS_7$, $PS_8$ | Detect that the punched and/or stapled copied sheets are slid to the predetermined position on the inclined plate 43a |
| Punch Sensor $PS_9$ | Detect that the punch drive motor $M_6$ is rotated by one revolution |
| Stapler Home Position Sensor $PS_{10}$ | Detect the home positions of the staplers 60 |
| Sensor | Function |
| Paper Press Bar Sensor $PS_{11}$ | Detect the home position of the paper press bar drive motor $M_5$ |
| Stapler Sensors $PS_{12}$, $PS_{13}$ | Detect that each of the stapler drive motors $M_9$ and $M_{10}$ is rotated by one revolution |
| Tray Upper Limit Sensor $PS_{14}$ | Detect that the position of the base 46a of the tray 46 exceeds the predetermined upper limit |
| Tray Lower Limit Sensor $PS_{15}$ | Detect that the position of the base 46a of the tray 46 is lower than the lower limit position |
| Stopper OFF Sensor $PS_{16}$ | Detect that the stopper 43c is moved downward to the predetermined position |
| Solenoid | Function |
| Solenoid $SD_1$ | Switch the path switching gate 42 |
| Solenoid $SD_2$ | Brake the base 46a of the tray 46 |

Figure 10:
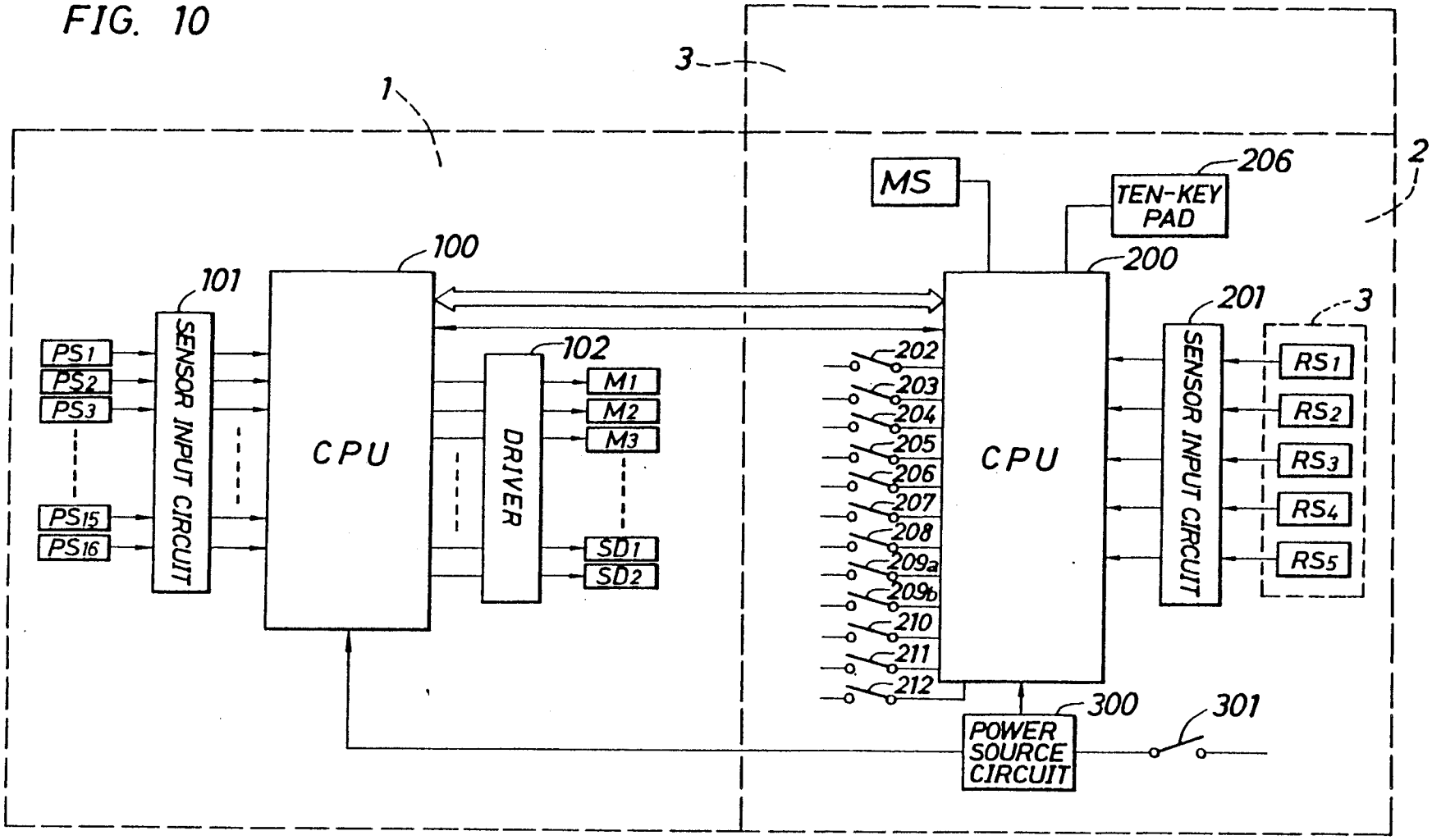
FIG. 10 is a diagram showing control circuits in the copied sheet handling apparatus and the copying machine.

FIG. 10 is a block diagram of control circuits of the copied sheet handling apparatus and the copying machine.

Figure 11:
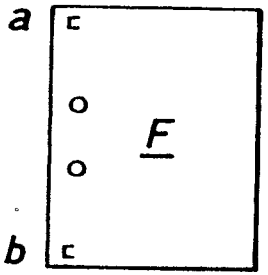
FIG. 11 is a view showing a copied sheet handling position according to the present invention.

The control circuit in the copied sheet handling apparatus 1 comprises the sensors $PS_1$ to $PS_{16}$, a sensor input circuit 101 for converting the analog signals into digital signals which can be processed by a CPU 100, and a driver 102 for driving the motors $M_1$ to $M_{11}$ and the solenoids $SD_1$ and $SD_2$. The control circuit in the copying machine 2 comprises the sensors $RS_1$ to $RS_5$ arranged in the RDF 3, an sensor input circuit 201 for converting analog sensor outputs into digital signals which can be processed by a CPU 200, a copy button 202 arranged in the form of an operation button in the operation panel in the copying machine 2, a size selection button 203 for selecting a size of a copying sheet, a mode selection button 204 for selection a handling mode of the copied sheet handling apparatus 1, a stapling position designation button 205 for designating a stapling position, a punching designation button 206 for designating whether punching is to be performed, and automatic document size detection button 207 for automatically determining a size of a copying sheet by detecting the size of the document in the RDF 3, a ten-key pad 208 for setting the number of copies or the number of sets of copies. Upon sequential depressions of the size selection button 203, the paper size is changed in the order of A3, B4, F4, A4, and B5. Further depressions of the button 203 allow repetitions of the above order. When the mode selection button 204 is depressed once, the stacking mode is set. When this button is depressed twice, the stapling mode is set. When the buttons depressed three times, the punching-stapling mode is selected. Further depressions of this button allow the repetitions of this order. When the stapling position designation button 205 is depressed once, the stapling position is designated as a corner a of the copied sheet F, as shown in FIG. 11. When the button 205 is depressed twice, the position is designated as a corner b. When the button 205 is depressed three times, the stapling positions are designated as both the corners a and b. The key input signals are coded by the CPU 200 in the copying machine and are output as 3-bit signals to the CPU 100 in the handling apparatus 1. When the punching designation button 206 is not depressed, "no punching" is designated. However, when the button 206 is depressed, "punching" is designated. This designation signal is coded by the CPU 200, and the corresponding code is transmitted to the CPU 100. The copying machine 2 further includes a power source circuit 300. When a power switch 301 arranged in the operation panel is turned on, power is supplied from the power source circuit 300 to the constituting components of the copying machine 2 as well as the components of the handling apparatus 1.

The operation panel of the copying machine 2 also includes a density control means and a magnification selecting means for selecting a reduction or enlargement ratio. However, these components are not directly associated with the present invention and a detailed description thereof will be omitted.

The operation of the copied sheet handling apparatus will be described below. The copied sheet handling apparatus of this embodiment has the following three handling modes.

(a) Stacking Mode

The document is simply copied as in the conventional copying machine without performing punching or stapling. The copied sheet is discharged on the discharge tray 40.

(b) Stapling Mode

A plurality of copied sheets are stapled with a stapler or staplers. In this mode, the stapling position can be designated by the stapling position designation button 205 as only the corner a or b, or both the corners a and b.

(c) Punching-Stapling Mode

A plurality of copied sheets are punched and stapled. In this case, only the central punching position is designated, and the corner a or b, or both the corners a and b can be designated as the stapling positions. For example, an operation for copying a document consisting of three A4 originals to obtain two sets of copied sheets will be described below.

The power switch 301 in the copying machine 2 is turned on regardless of the operation mode of the copied sheet handling apparatus. Three originals are placed on the document table 11 of the RDF 3 in an order of the first page, the second page, and the third page from the top.

When the power switch 301 is turned on, the following loads are initialized. The stapler moving motor $M_3$ is rotated by the predetermined number of pulses (e.g., 20 pulses) in the forward direction and then in the reverse direction. When the sampler home position sensor $PS_{10}$ is turned on, the motor $M_3$ is stopped. The side plate distance adjusting motors $M_{4a}$ and $M_{4b}$ are rotated by the predetermined number of pulses each (e.g., 20 pulses) in the forward and reverse directions and then in the reverse and forward directions, respectively. When the side plate home position sensors $PS_{4a}$ and $PS_{4b}$ are turned on, the motors $M_{4a}$ and $M_{4b}$ are stopped. The paper press bar drive motor $M_5$ is driven in the forward direction until the paper press bar sensor $PS_{11}$ is turned on. The punch drive motor $M_6$ is rotated in the forward direction until the punch sensor $PS_9$ is turned on. The stopper drive motor $M_7$ is rotated in the reverse direction upon a lapse of a predetermined period of time after the paper press bar drive motor $M_5$ and the punch drive motor $M_6$ are completely initialized. The stopper drive motor $M_7$ continues to rotate until the stopper ON sensor $PS_5$ is turned on. The position corresponding to the stop of the stopper drive motor $M_7$ is the standard position. In this case, the punching or stapling position determined by the position of the stopper 43c, that is, the longitudinal depth $d_1$ is the standard position (e.g., 20 mm). The stapler drive motors $M_9$ and $M_{10}$ continue to rotate until the stapler sensors $PS_{12}$ and $PS_{13}$ are turned off if they are kept on. The above operations are the initialization operations.

Stacking Mode

Figure 12:
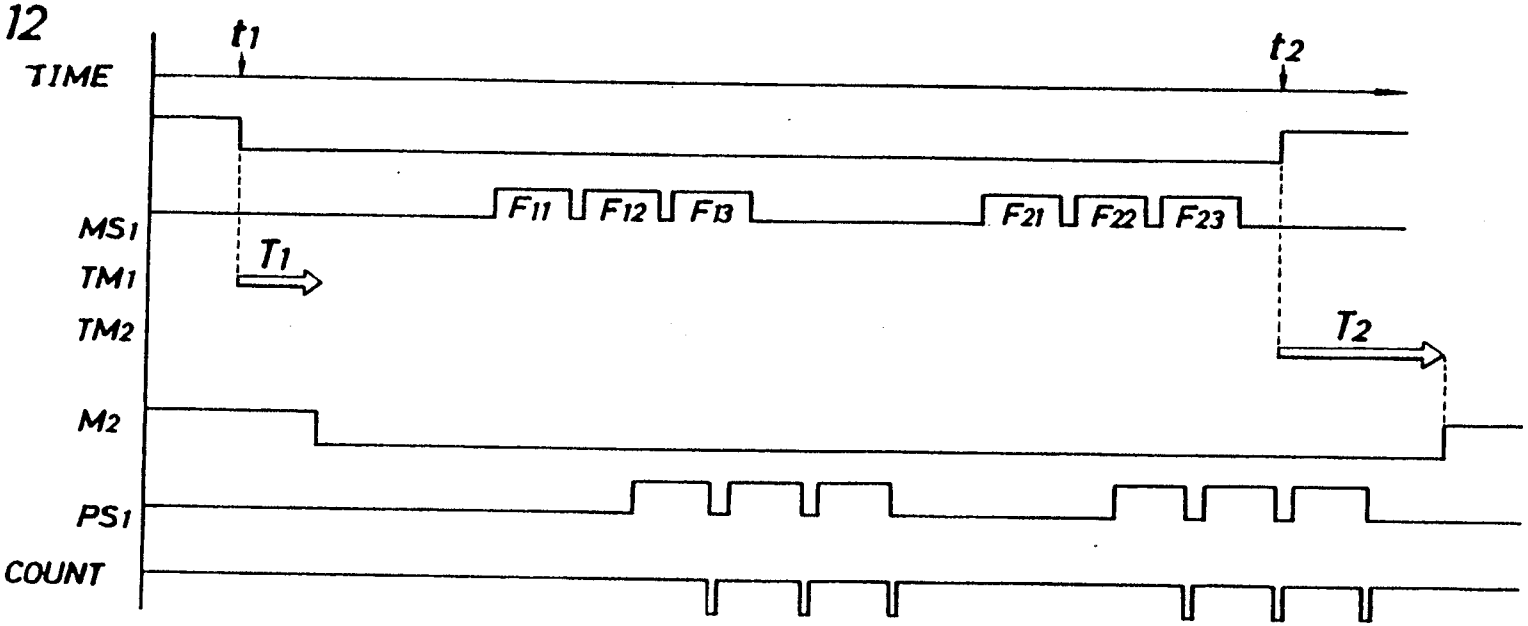
FIG. 12 is a timing chart for explaining the operation in the stacking mode according to the present invention.

FIG. 12 is a timing chart for the stacking mode.

The operator depresses the mode selection button 204 in the operation panel in the copying machine 2 once to select the stacking mode.

The operator depresses the size selection button 203 four times to select the A4 paper size.

When the operator depresses the copy button 202 at time $t_1$, the RDF 3 is operated to feed the lowermost original (the third page in this case) and the fed original is moved along the glass plate 10 of the copying machine 2, as previously described. Meanwhile, the original is illuminated by the optical system 19, and light reflected by the original is emitted on the photosensitive drum 23, thereby forming a latent image of the original image. In this manner, a series of electrophotographic operations are performed.

A transfer sheet F of the A4 size selected by the size selection button 203 is fed from the cassette 27. The visible or toner image of the original image is transferred by the transfer unit 28 to the transfer sheet P. After the image is fixed by the fixing unit 30, the sheet is discharged by the discharge roller 31 outside the copying machine. The discharge of the sheet F11 is detected by the discharge microswitch $MS_1$.

The ON signal from the copy button 202 is transmitted to the CPU 100 in the control circuit in the handling apparatus 1, and a start timer $TM_1$ arranged in the CPU 100 is started. After a lapse of a predetermined period of time of the start timer $TM_1$, the copied sheet convey motor $M_2$ in the handling apparatus 1 is started. As a result, the first copied sheet $F_{11}$ (the third page) discharged from the copying machine 2 is directed toward the discharge direction by the path switching gate 42. The sheet $F_{11}$ is discharged by the convey rollers 41 onto the discharge tray 40. The discharge of the sheet $F_{11}$ is detected by the discharge sensor $PS_1$, and an output from the discharge sensor $PS_1$ is temporarily input to the CPU 100 through the sensor input circuit 101 and to the CPU 200. The CPU 200 performs a count-up operation every trailing edge of the output from the discharge sensor $SP_1$.

After the first original (the third page) is fed in the RDF 3, the RDF 3 feeds the next or second original (the second page), and the copying machine 2 performs copying as in the first original. The above operation is also repeated for the third original of the document. The copied sheets are sequentially discharged from the copying machine. The sheets $F_{12}$ and $F_{13}$ discharged from the copying machine 2 are discharged onto the discharge tray 40 by the convey rollers 41 of the handling apparatus 1. Meanwhile, the CPU 200 continues the count-up operations every trailing edge of the output from the discharge sensor $PS_1$.

While the copied sheets $F_{11}$, $F_{12}$, and $F_{13}$ as a set (three pages) are discharged onto the discharge tray 40, the CPU 200 compares the count based on the trailing edges of the outputs from the discharge sensor $PS_1$ with the count based on the outputs form the recirculation discharge sensor $RS_5$ arranged in the RDF 3. If these counts coincide with each other, the originals of the document for the second set of copied sheets are fed.

The document feeding for the second set of copied sheets by the RDF 3 and the conveying and discharge of the copied sheets in the copied sheet handling apparatus 1 are the same as those of the first set of copied sheets, and a description thereof will be omitted. The second set of copied sheets are represented by reference symbols $F_{21}$, $F_{22}$, and $F_{23}$ in FIG. 12.

As is apparent from FIG. 12, when the last copied sheet $F_{23}$ (the first page) of the second set is discharged from the copying machine 2 and the discharge thereof is detected by the discharge microswitch $MS_1$, copying is ended after a lapse of a predetermined period. When a predetermined time interval $T_2$ has elapsed after the end of copying, the copied sheet convey motor $M_2$ is stopped. This time interval $T_2$ is counted by a stop timer $TM_2$ incorporated in the CPU 100. The timer $TM_2$ is started from copying end time $t_2$.

As described above, the stack mode is ended.

Stapling Mode

Figure 13:
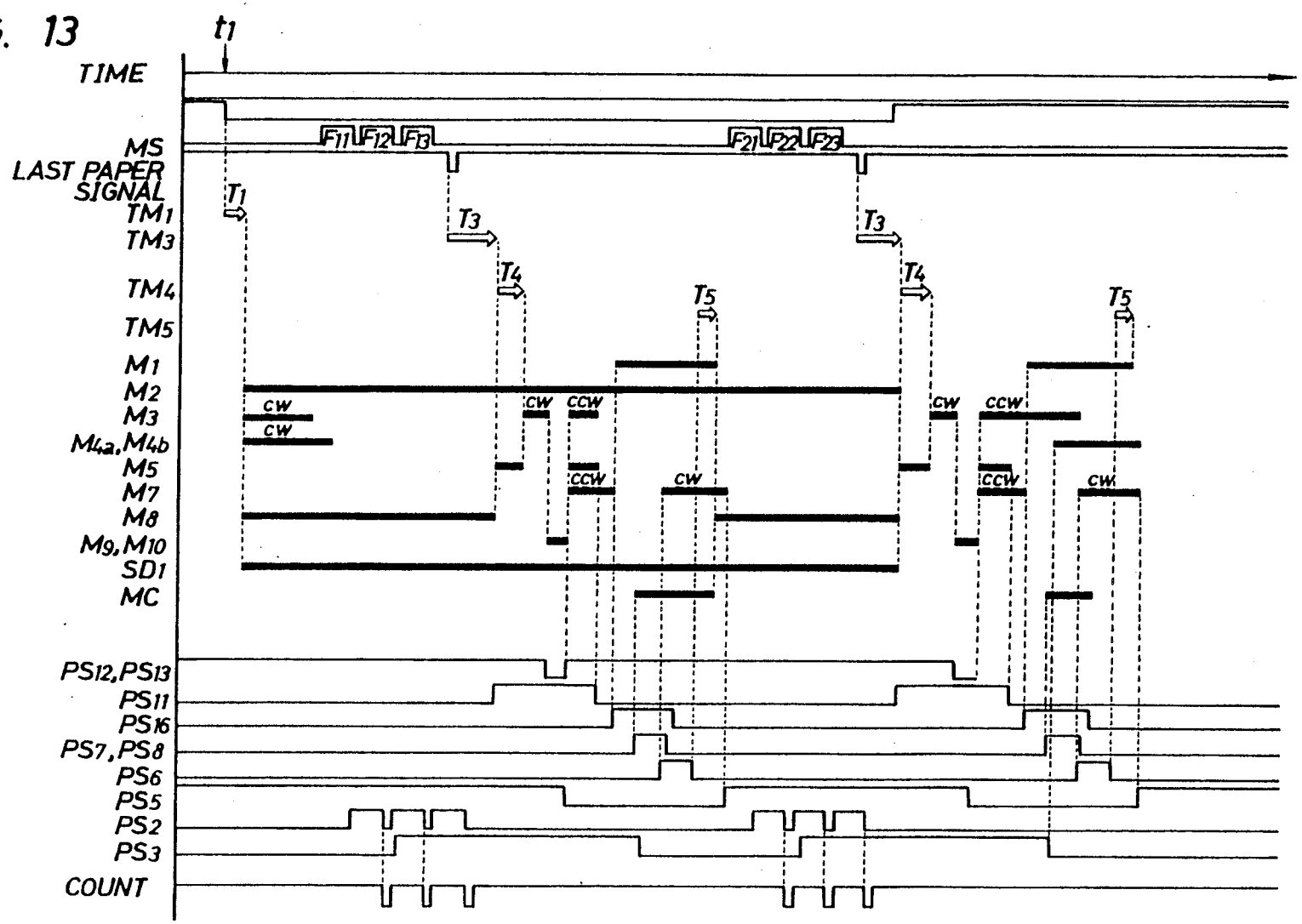
FIG. 13 is a timing chart for explaining the stapling mode according to the present invention.

FIG. 13 is a timing chart for the stapling mode.

The operator depresses the mode selection button 204 in the operation panel twice to select the stapling mode and operates the size selection button 203 to select the A4 paper size. The operator depresses the stapling position designation button 205 once to designate the stapling position as the corner a.

When the operator depresses the copy button 202 at time $t_1$, the originals of the document are fed by the RDF 3 one by one, and the originals are sequentially copied by the copying machine 2. The copied sheets are then sequentially output from the copying machine 2. The discharge of the copied sheets $F_{11}$, $F_{12}$, and $F_{13}$ of the first set is detected by the discharge microswitch $MS_1$. The CPU 200 counts the number of discharged sheets on the basis of the outputs form the microswitch $MS_1$. When the count (three in this case) representing the number of copied sheets output form the copying machine 2 coincides with the count (three in this case) on the basis of the recirculation discharge sensor $RS_5$ in the RDF 3, a last paper signal is output after a lapse of a short period of time. The stapling start timer incorporated in the CPU 100 starts counting upon generation of the last paper signal.

When the time interval $T_1$ set in the start timer $TM_1$ incorporated in the CPU 100 has elapsed after the copy button 202 is depressed, the convey motor $M_2$, the stapler moving motor $M_3$, the side plate distance adjusting motor $M_{4a}$ and $M_{4b}$, and the stacker fan drive motor $M_8$ are rotated and at the same time the path switching solenoid $SD_1$ is energized. As a result, the convey rollers 41 are rotated and the two staplers 60 are moved from the home positions toward the direction of the punching machine 50 through the slidable members 57 and 58. The side plates 43$b_1$ and 43$b_2$ are moved from the home positions to the positions corresponding to the paper size, and the stacker fan is driven. The path switching gate 42 is directed toward the copied sheet handling direction. Each of the copied sheets is swung by the side plates 43$b_1$ and 43$b_2$ and is thus aligned in position.

The stapler moving motor $M_3$ and the side plate distance regulating motors $M_{4a}$ and $M_{4b}$ are rotated after stapling in the forward direction by an amount (e.g., 20 pulses) determined by the selected paper size upon energization of the apparatus and then are rotated in the reverse direction. The stapler moving motor $M_3$ is stopped when the home position sensor $PS_{10}$ is turned on. The side plate distance regulating motors $M_{4a}$ and $M_{4b}$ are stopped when the home position sensors $PS_{4a}$ and $PS_{4b}$ are turned on. Therefore, the staplers and the side plates are always kept at the corresponding home positions. The motors $M_3$ and $M_{4a}$ and $M_{4b}$ are kept rotated in the forward direction until the home position sensors $PS_{10}$ and $PS_{4a}$ and $PS_{4b}$ are turned off if these sensors are kept on upon initial forward rotation of the motors $M_3$ and $M_{4a}$ and $M_{4b}$.

After the lapse of the time interval $T_1$ after time $t_1$, the stapler moving motor $M_3$ is rotated to cause the staplers 60 to move by a distance slightly outside the width of the paper size A4. The side plate distance regulating motors $M_{4a}$ and $M_{4b}$ are rotated by an amount enough to move the side plates 43$b_1$ and 43$b_2$ to the positions substantially corresponding to the A4 paper size. In this above operation, the staplers 60 are kept at positions slightly outside the edge of the paper because all the copied sheets are properly set in the handling position since the opening for the handling position for punching or stapling of a plurality of copied sheets is not so wide.

The copied sheets $F_{11}$, $F_{12}$, and $F_{13}$ sequentially fed to the handling apparatus 1 are directed to the handling direction by the path switching gate 42. The sheets are fed by the convey rollers 44 to the stacker 43, which is detected by the discharge sensor $PS_2$.

When a preset time interval $T_3$ of a stapling start timer $TM_3$ after generation of the last paper signal has elapsed, a paper press bar actuating timer $TM_4$ incorporated in the CPU 100 is stared and the paper press bar drive motor $M_5$ is rotated. At this time, the stacker fan is stopped. After the lapse of the preset time $T_4$ of the paper press bar actuating timer $TM_4$, the paper press bar drive motor $M_5$ is stopped, and the stapler moving motor $M_3$ is rotated again, thereby moving the two staplers 60 toward the direction of the punching machine 50. The motor $M_3$ is rotated and stopped at a position where the staplers 60 are located slightly within the area of the A4 paper selected by the size selection button.

When the stapler moving motor $M_3$ is stopped, the stapler drive motors $M_9$ and $M_{10}$ are rotated. Rotation of the drive motors $M_9$ and $M_{10}$ is transmitted as linear movement of the levers 63 through the gears 61 and 62. The V-shaped levers are pivoted about the pivot pins A. As a result, the levers 65 are pivoted and the press members 67 press the springs 66 and are moved downward. The thin plates 68 are moved downward along the guides 69, and each staple is separated by the corresponding thin plate 68 and is pushed outside. Therefore, the copied sheets are stapled with staples.

When the stapler drive motors $M_9$ and $M_{10}$ are stopped, the stapler moving motor $M_3$ is rotated in the reverse direction and the staplers 60 are moved to the positions slightly outside the A4 paper. Thereafter the stapler moving motor $M_3$ is stopped, and at the same time the paper press bar drive motor $M_5$ is rotated. When the paper press bar sensor $PS_{11}$ detects the home position of the drive motor $M_5$, the motor $M_5$ is stopped.

Figure 5:
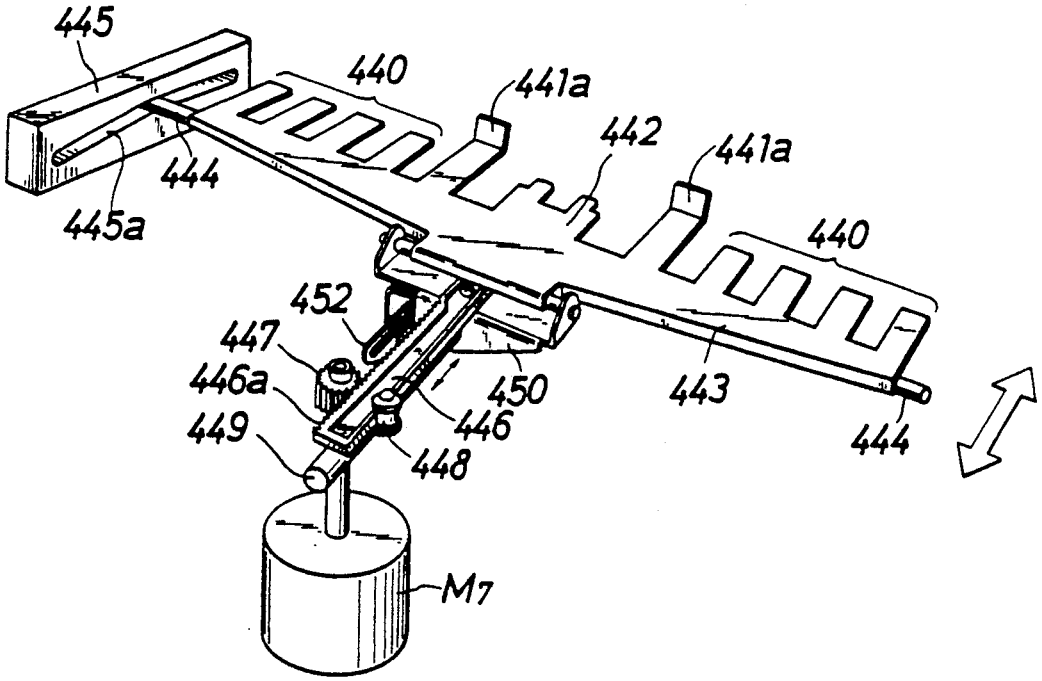
FIG. 5 is a perspective view of a stopper driving mechanism.

At this time, the stopper drive motor $M_7$ starts rotation in the reverse direction. As is apparent from FIG. 5, the pinion 447 is rotated and the drive rod 446 meshed therewith is retracted. As a result, the plate member 443 is guided by the right and left guides 445 and is retracted. When the plate member 443 is retracted to some extent, the projections 440 and 441 extending forward are moved downward since the grooves 445*a* are inclined. The projections 440 and 441 are moved below the openings 431*a*, 431*b*, and 431*c* of the inclined plate 43*a*. In particular, the upright portions 441*a* of the projections 441 are moved below the openings 431*b*, the copied sheets ($F_{11}$, $F_{12}$, and $F_{13}$) can be slid along the inclined plate 43*b*. When the stopper 43*c* is retracted to the predetermined position, the stopper OFF sensor $PS_{16}$ is turned on, and the stopper drive motor $M_7$ is stopped.

When the stopper OFF sensor $PS_{16}$ is turned on and at the same time the copied sheet convey motor $M_1$ is rotated, the shaft 466 shown in FIG. 8 is rotated, and the feed roller 462 is rotated through the rollers 463 and 464 and the belt 465. The stapled set of copied sheets ($F_{11}$, $F_{12}$, and $F_{13}$) placed on the inclined plate 43*a* is fed out by the feed roller 462 and is slid along the inclined plate 43*a*. When the temporary stop sensors $PS_7$ and $PS_8$ arranged along the widthwise direction of the copied sheet detect the leading edge of the copied sheets, a convey clutch MC (FIG. 9) is actuated to rotate the convey rollers 47 and 48. The copied sheets are conveyed by the convey rollers 47. When the leading edge of the set of the copied sheet is detected by the tray discharge sensor $PS_6$, the stopper drive motor $M_7$ is rotated and the plate member 443 is moved forward by the mechanism shown in FIG. 5.

When the tray discharge sensor $PS_6$ detects the trailing edge of the set of copied sheets and is turned off, an $M_1$ OFF timer $TM_5$ incorporated in the CPU 100 is started. After a lapse of a predetermined time interval $T_5$ preset in the $M_1$ OFF timer $TM_5$, the copied sheet convey motor $M_1$ is stopped, and the stacker fan drive motor $M_8$ is started again to start ventilation.

Meanwhile, when the stopper 43C is moved forward and reaches a predetermined stop position, an output from the stopper ON sensor $PS_5$ becomes OFF. The stopper drive motor $M_7$ is stopped at this timing.

One set of copied sheets ($F_{11}$, $F_{12}$, and $F_{13}$) is placed on the base 46*a* of the storage tray 46.

While the handling apparatus 1 performs stapling of the set of copied sheets, the RDF 3 starts feeding of the document for the second set of copied sheets. The copying machine 2 repeats the same electrophotographic operations as in the first set of copied sheets.

As shown in FIG. 13 when the second set of copied sheets $F_{21}$, $F_{22}$, and $F_{23}$ are sequentially discharged from the copying machine 2 and the discharge thereof is detected by the discharge microswitch $MS_1$, a last paper signal is output. The stapler start timer $TN_3$ is started to count the preset time interval $T_3$. After the lapse of the preset time interval $T_3$, the paper press bar actuating timer $TM_4$ incorporated in the CPU 100 is started and at the same time the paper press bar drive motor $M_5$ is started. The subsequent operation sequence of the timers and the motors are the same as in the first set of copied sheets, and a description thereof will be omitted. Only the differences between the second set and the first set are the operation of the staplers 60 and the side plates $43b_1$ and $43b_2$. More specifically, as for the second set, the staplers 60 return to the home positions after stapling. This can be achieved such that the stapler moving motor $M_3$ is kept rotated until the home position sensor $PS_{10}$ detects the home positions of the staplers 60. The side plates $43b_1$ and $43b_2$ also return to the home positions. This can be similarly achieved such that the side plate distance regulating motor $M_{4a}$ and $M_{4b}$ are kept rotated until the side plate home position sensors $PS_{4a}$ and $PS_{4b}$ detect that the side plates reach the corresponding home positions.

In the above embodiment, two sets of copied sheets are prepared. The stacker fan drive motor $M_8$ is not started when the $M_1$ OFF timer $TM_5$ counts the time interval $T_5$.

In this manner, the stapling mode is ended.

The above operations have been made when an A4 size is selected as a paper size. An F4 size (8.5" × 11") which is popular in U.S.A is selected as a paper size of a copied sheet, and its stapling by using a handling apparatus having a punching machine having three punching holes and staplers will be described with reference to FIG. 14.

The size selection button 203 on the operation panel is operated to select the F4 size, and the stapling position designation button 205 is depressed twice to designate the stapling positions as the corners a and b.

Figures 15A, 15B, 15C:
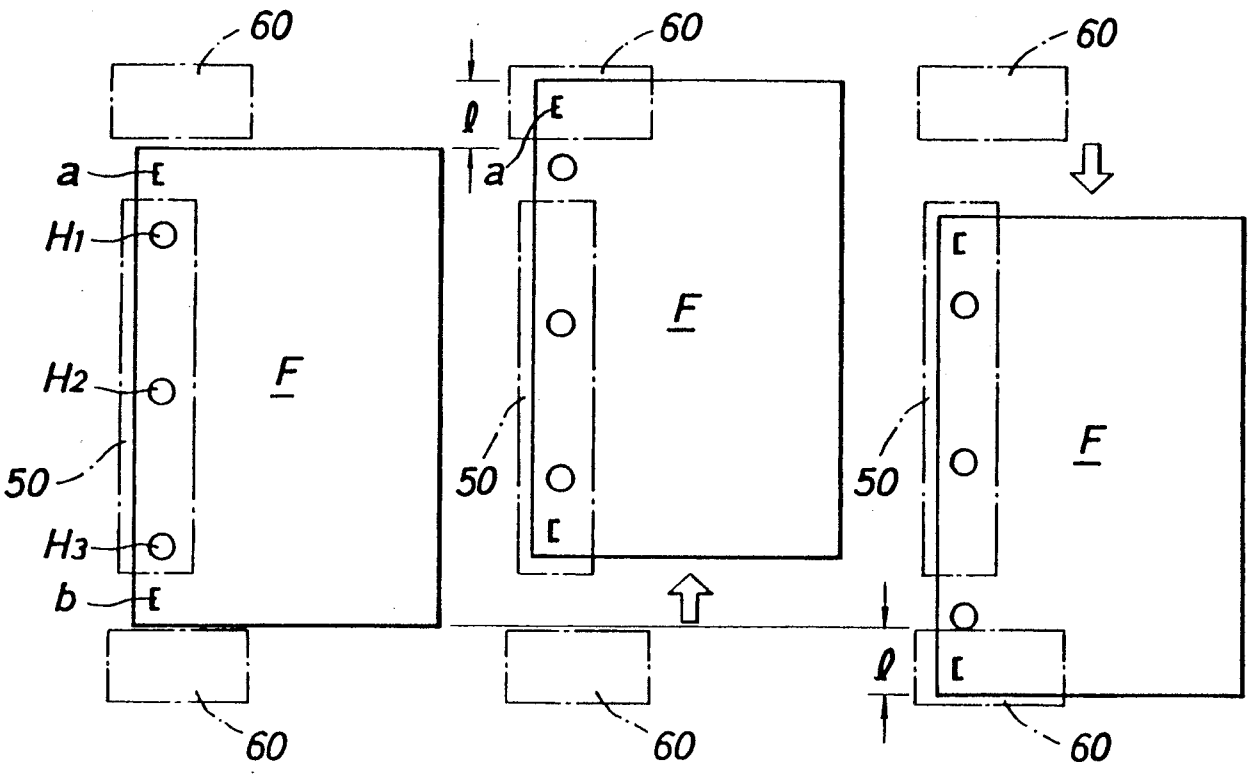
FIGS. 15A to 15C are views showing the relationship between punched holes and stapling positions of the F4 sheets.

The operations performed when the preset time interval $T_3$ has elapsed upon depression of the copy button 202 are the same as those for the A4 size. When the time interval $T_3$ has elapsed, the stapler moving motor $M_3$ is rotated to move the two staplers toward the punching machine 50. The staplers 60 are moved as close to the three-hole punching machine 50 and are stopped. In this case, as shown in FIG. 15A, of three holes $H_1$, $H_2$, and $H_3$, the punch holes $H_1$ and $H_3$ come very close to the stapling positions a and b. Therefore, both end portions of the punching machine 50 come very close to the stapling positions a and b. The staplers 60 cannot be located at the stapling positions of F4 size sheets F and must be stopped outside the stapling positions a and b.

When the stapler moving motor $M_3$ is stopped, the side plate distance adjusting motors $M_{4a}$ and $M_{4b}$ are rotated in the reverse and forward directions, so that the side plates $43b_1$ and $43b_2$ (FIG. 3) are moved by a predetermined distance corresponding to the F4 size in the widthwise direction (i.e., the side plates are moved in a direction perpendicular to a copied sheet feed direction). As shown in FIG. 15B, the copied sheets F are moved by a predetermined distance l in one direction. This distance l is determined by the number of pulses applied to the motors $M_{4a}$ and $M_{4b}$ as pulse motors. When the copied sheets are stopped at a predetermined position in one direction, the paper press bar actuating timer $TM_4$ incorporated in the CPU 100 is started and at the same time the paper press bar drive motor $M_5$ is rotated. The paper press bar is moved downward and presses the leading end of a set of copied sheets. When the preset time interval $T_4$ set in the paper press bar actuating timer $TM_4$ has elapsed, the stapler drive motor $M_9$ is rotated to staple the copied sheets at the corner a with a staple. When stapling of the copied sheets at the corner a is completed, the paper press bar is moved upward and is stopped when the home position of the drive motor $M_3$ is detected by the paper press bar sensor $PS_{11}$.

The side plate distance adjusting motors and $M_{4a}$ and $M_{4b}$ are rotated in the forward and reverse directions in response to an output from the paper press bar sensor $PS_{11}$. In this case, the side plates $43b_1$ and $43b_2$ are moved in opposite directions of the copied sheet width. This distance is a distance $2l$ at which the copied sheets F pass through a central position (position indicated in FIG. 15A) and reach a predetermined position on the opposite side. This distance is determined by the number of pulses applied to the motors $M_{4a}$ and $M_{4b}$ as the pulse motors. As a result, the copied sheets F are moved to the predetermined position in the opposite direction (downward in FIG. 15C), as shown in FIG. 15C. In this case, the paper press bar actuating timer $TM_4$ incorporated in the CPU 100 is operated again to rotate the paper press bar drive motor $M_5$. The paper press bar is moved downward again to hold the leading end of the copied sheets. When the time interval T4 preset in the timer $TM_4$ has elapsed, the stapler drive motor $M_{10}$ is rotated to staple the copied sheets at the corner b with a staple. When stapling of the copied sheets at the corner b is completed, the paper press bar is moved upward in the same manner as described above. When the paper press bar sensor $PS_{11}$ detects that the paper press bar has returned to the home position, the motor $M_5$ is stopped, and the side plate distance adjusting motors $M_{4a}$ and $M_{4b}$ are rotated in the reverse and forward directions. Therefore, the side plates $43b_1$ and $43b_2$ are moved by the predetermined distance l in the copied sheet widthwise direction, and the copied sheets return to the initial central position.

The subsequent operations of the above components are the same as those for the A4 size, and a detailed description thereof will be omitted.

Figure 14:
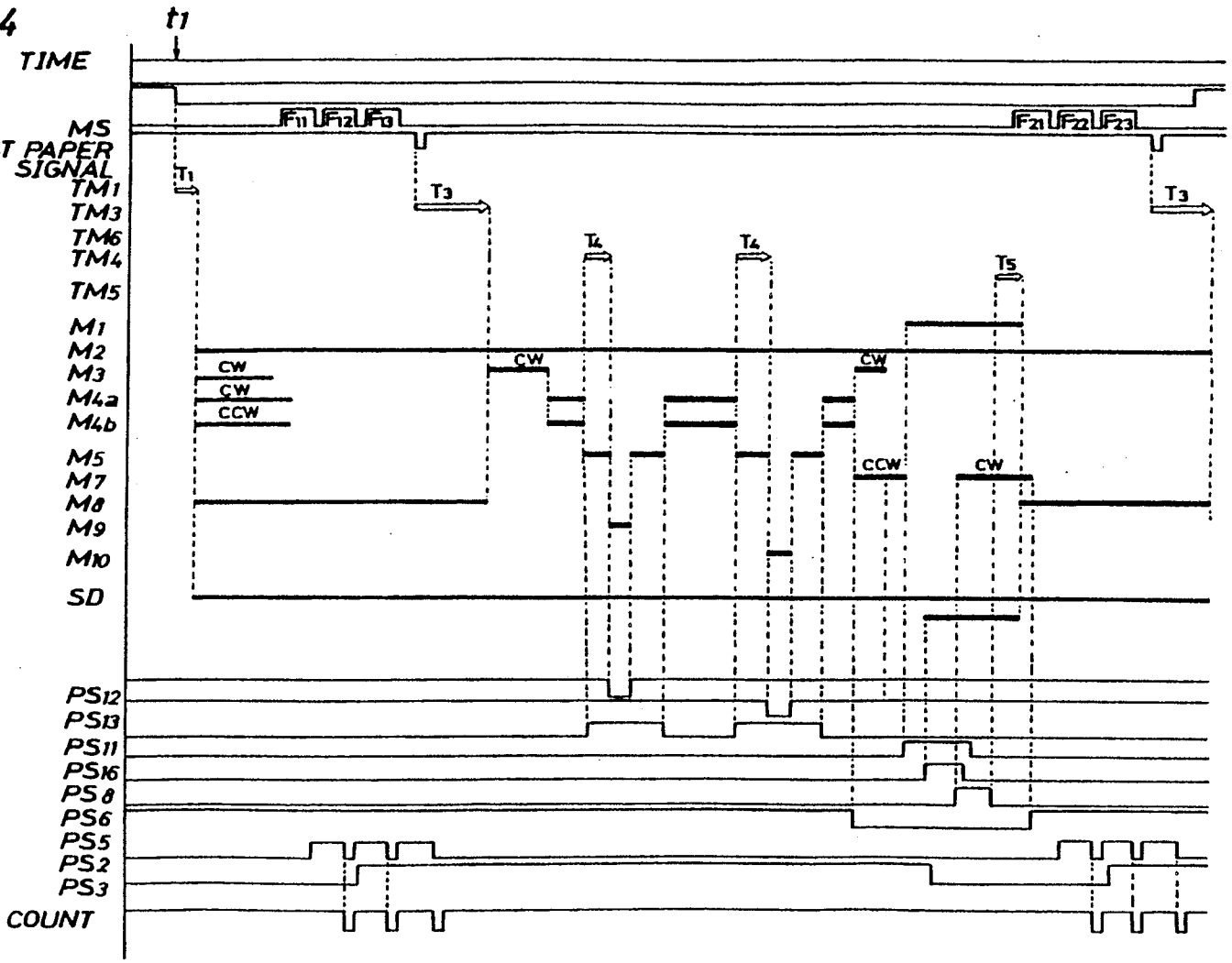
FIG. 14 is a timing chart of a stapling mode when F4 sheets are used as recorded sheets.

FIG. 14 shows only operations for copied sheets $F_{11}$, $F_{12}$, and $F_{13}$ of the first set, the same operations as described above are performed for the second and subsequent sets of sheets, and a detailed description thereof will be omitted.

Punching-Stapling Mode

Figure 16:
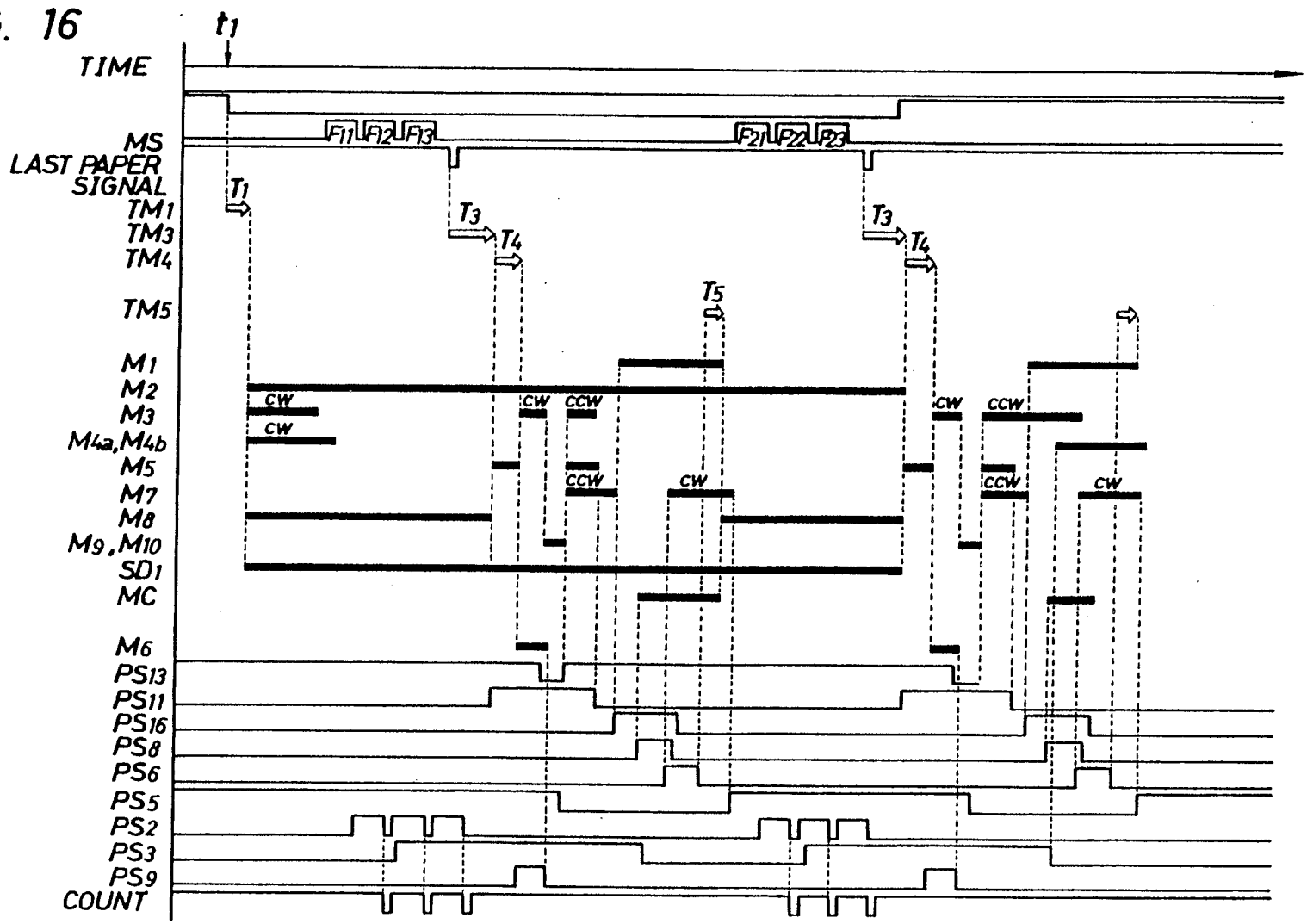
FIG. 16 is a timing chart for explaining the punching-stapling mode according to the present invention.

FIG. 16 is a timing chart in the punching-stapling mode.

The operator depresses the mode selection button 204 in the operation panel to select to the punching-stapling mode and depresses the size selection button 203 to select the A4 paper size. Alternatively, the operator may depress the automatic document size detection button 207. The operator depresses the punch designation button 206 to designate "punching".

The timing chart of FIG. 16 is compared with that of FIG. 13. As is apparent from this comparison, the stapling operations in FIG. 16 are the same as those in FIG. 13, and only the punching operations are added. In other words, a sequence of the punch drive motor $M_6$ and the punch sensor $PS_9$ is added.

It should be noted that refer to the stapling operations of FIG. 15 for the stapling operations in FIG. 16, and that only the punching operations will be described below.

When the preset time interval $T_3$ of the paper press bar actuating timer incorporated in the CPU 100 has elapsed, the punch drive motor $M_6$ is started. As shown in FIG. 6, when the punch drive motor $M_6$ is rotated, the worm gear 51 in the punching machine 50 is rotated and the gear 53 meshed with the worm gear 51 is rotated. The two crank members 54a and 54b fixed to the rotating shaft of the gear 53 are rotated. In this case, since the crank members 54a and 54b are fixed at a predetermined angular interval (e.g., 50°), the punching operations of the punching pins 56a and 56b through the swingable members 55a and 55b are differentiated as a function of time. With this arrangement, the load acting on the punch drive motor $M_6$ can be reduced.

When the punch sensor $PS_9$ detects that the punch drive motor $M_6$ is rotated by one revolution and its output goes from "H" level to "L" level, the punch drive motor $M_6$ is stopped.

The first set of punched and stapled sheets $F_{11}$, $F_{12}$, and $F_{13}$ are conveyed by the convey rollers 47 and 48 onto the storage tray 46. The discharge operation after punching and stapling is the same as that in the stapling operation, and a description thereof will be omitted.

Punching and stapling of the second set are the same as those of the first set, and a description thereof will be omitted.

When punching and stapling for the second set of copied sheets $F_{21}$, $F_{22}$, and $F_{23}$ are completed as in the first set, the second set is discharged onto the storage tray 46.

A case of an F4 size will be described with reference to FIGS. 17. The stapling operations are the same as those described with reference to FIG. 14. When the side plate distance adjusting motors $M_{4a}$ and $M_{4b}$ are stopped at the end of stapling operations and the copied sheets return to the central position, the paper press bar actuating timer $TM_4$ incorporated in the CPU 100 is started and at the same time the paper press bar drive motor $M_5$ is rotated. When the time interval T4 has elapsed, the motor $M_5$ is stopped to hold the sheets.

When the time interval T4 of the paper press bar actuating timer $TM_4$ has elapsed, the punch drive motor $M_6$ is started to move the punch pins downward in the same manner as in the A4 size, thereby forming punched holes in the copied sheets. When the punch sensor $PS_9$ detects that the punch drive motor $M_6$ has rotated by one revolution, the punch drive motor $M_6$ is stopped. In this case, the paper press bar is moved upward and is stopped when the paper press bar sensor $PS_{11}$ detects its home position.

Figure 17:
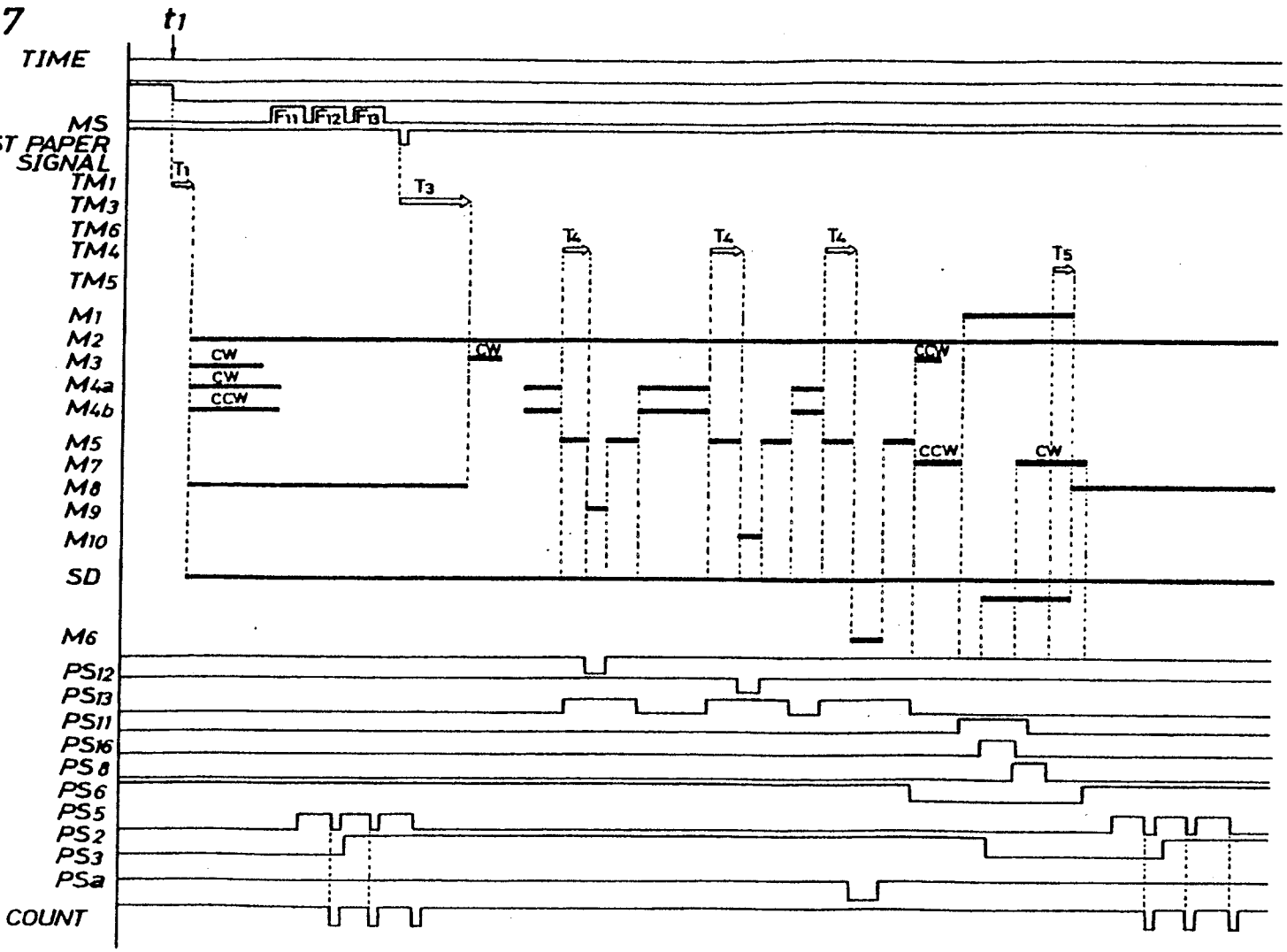
FIG. 17 is a timing chart of a punching-stapling mode when the F4 sheets are used as recorded sheets.
Figure 18:
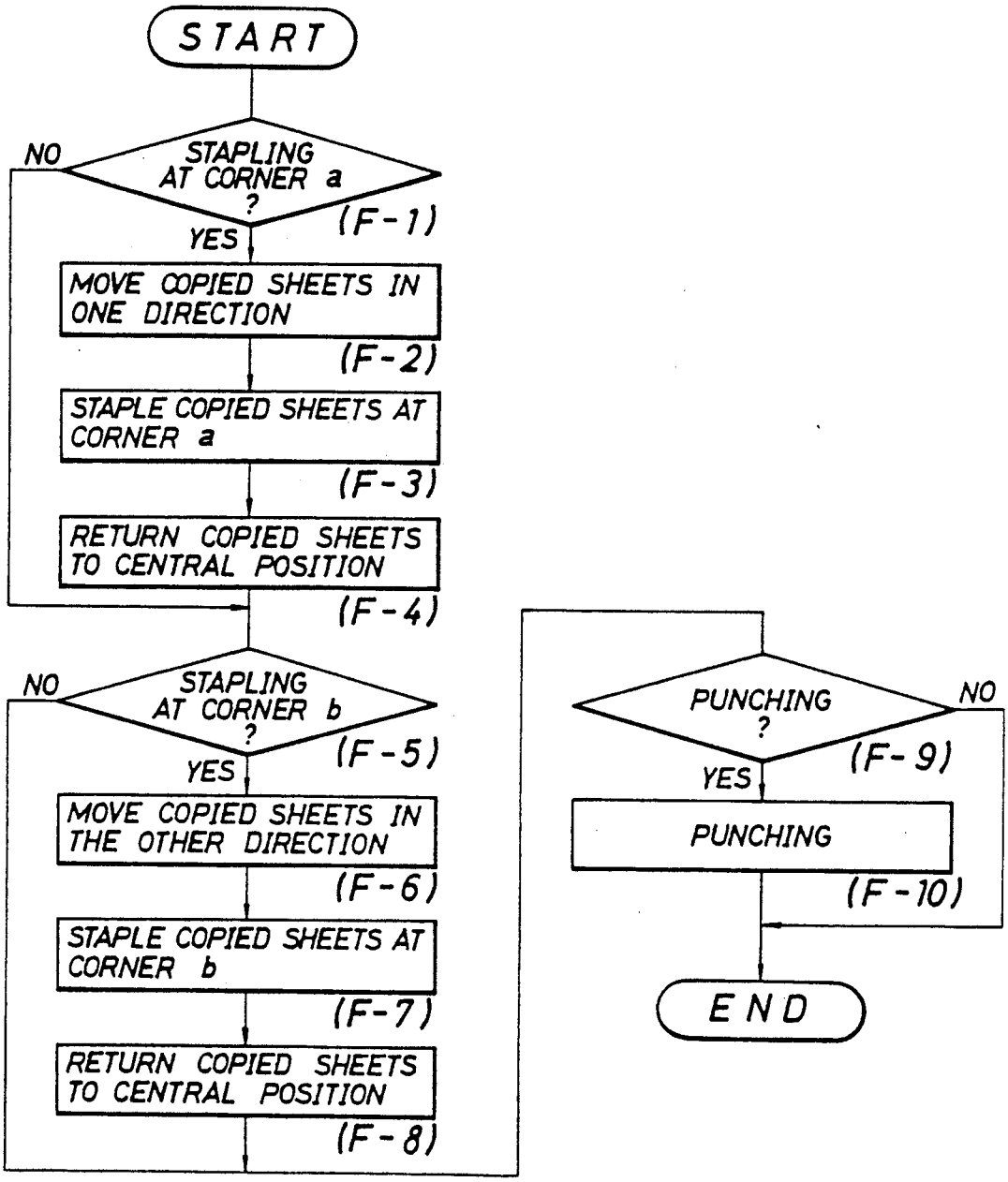
FIG. 18 is a flow chart for explaining a punching-stapling operation in the mode shown in FIG. 17.

FIG. 18 is a flow chart showing an operation of the CPU 100 when the F4 copied sheets shown in FIG. 17 are stapled and punched.

The CPU 100 determines in step F-1 on the basis of an operation of the stapling position designation button 205 whether the copied sheets are stapled at the corner a. As a result, when stapling at the corner a is designated, the side plate distance adjusting motors $M_{4a}$ and $M_{4b}$ are rotated to move the side plates $43b_1$ and $43b_2$ by a predetermined distance along one direction of the copied sheet width (F-2). The stapler drive motor $M_9$ is rotated to staple the copied sheets at the corner a with a staple (F-3).

When stapling at the corner is completed, the side plate distance adjusting motors $M_{4a}$ and $M_{4b}$ are rotated in the reverse directions to return the side plates $53b_1$ and $43b_2$ to the central position (F-4). Meanwhile, the CPU 100 determines by a signal based on an operation of the stapling position designation button 205 whether the copied sheets are stapled at the corner b (F-5). If YES in step F-5, the side plate distance adjusting motors $M_{4a}$ and $M_{4b}$ are continuously rotated, and the side plates $43b_1$ and $43b_2$ are moved by a predetermined direction in the opposite widthwise direction, while passing through the central position (F-6). The stapler drive motor $M_{10}$ is operated to staple the copied sheets at the corner b with a staple (F-7). After stapling is completed, the side plates $43b_1$ and $43b_2$ are turned to the central position (F-8).

If NO in step F-5, i.e., if stapling at the corner b is not designated, the flow jumps to step F-9 without executing steps F-6, F-7, and F-8.

In step F-9, the CPU 100 determines on the basis of an operating state of the mode selection button 204 whether punching is designated. If YES in step F-9, the punch drive motor $M_6$ is driven to move the punch pins downward, thereby performing punching (F-10). However, if NO in step F-9, the flow skips step F-10, and a series of operations are ended.

In this manner, punching is performed after stapling is completed. Therefore, the punched holes can be accurately aligned.

In the above embodiment, no problem occurs when the two sets of copied sheets are prepared. However, when the number of sets is large, the uppermost set on the base 46a may exceed the predetermined upper limit level. When this state is detected by the tray upper limit sensor $PS_{14}$, the tray lifting motor $M_{11}$ is rotated to move the base 46a downward by one step. In this case, the solenoid $SD_2$ is actuated to brake the rotating shaft of the tray lifting motor $M_{11}$ to prevent excessive downward movement of the base 46a. When the number of sets stacked on the base 46a is increased, the above operation is repeated. When the tray lower limit sensor $PS_{15}$ detects that the base 46a reaches the lower limit position, a discharge-over signal is output. An alarm lamp is turned on or an alarm buzzer is operated on the basis of the discharge-over signal.

In the above embodiment, a sensor may be conveniently arranged to detect the empty state of the staple cartridge, and a staple empty signal may be output. Another sensor may be conveniently arranged to alarm the full of punching dust in the case.

In the above embodiment, the stapling position is a predetermined corner position of the copied sheet, and the punching position is a given central position of the copied sheet. However, the stapling and punching positions may be arbitrarily selected.

In the above embodiment, the storage tray for finally storing the handled copied sheets and the lifting tray are illustrated. These trays are suitable for handling a large amount of document. However, if the handling quantity is not so large, a conventional thin tray may be used.

The recorded sheet handling apparatus according to the present invention is suitably used as a copied sheet handling apparatus cooperated with the copying machine. However, the recorded sheet handling apparatus according to the present invention may be combined with a recording apparatus (e.g., a printing press and a card handling apparatus) for handling a plurality of sheets having a predetermined size.

According to the present invention as has been described above, in a recorded sheet handling apparatus for sequentially stacking a set of recorded sheets externally fed one by one and punching and stapling the set of recorded sheets at the holding position, when the size of the recorded sheets is a predetermined size, the recorded sheets are moved to a predetermined position in a widthwise direction, the recorded sheets are turned to the initial position after stapling, and then the recorded sheets are punched. Even if the recorded sheet has a size of 8.5" × 10" or 8.5" × 11" as in F4 size paper and three holes are to be punched in each recorded sheet, the punching machine and the staplers can be arbitrarily arranged, and punching and stapling can be performed without posing any design and manufacturing problems.

What we claim is:

1. A recorded sheet handling apparatus comprising:

means for temporarily holding a set of recorded sheets externally fed one by one;

a moving mechanism for moving the recorded sheets by a predetermined distance in a direction perpendicular to a recorded sheet convey direction prior to stapling when a size of the recorded sheets is a predetermined size;

at least one of respectively means for punching and means for stapling the set of recorded sheets while the sheets are held by the recording means; and means for conveying the copied sheets from said one means so as to discharge the sheets.

2. An apparatus according to claim 1, wherein said moving mechanism moves the recorded sheets in opposite directions when a stapling position is separated from a center of the recorded sheets on one side in a direction perpendicular to the recorded sheet convey direction and when the stapling position is separated from the center on the other side in the direction perpendicular to the recorded sheet convey direction.

3. An apparatus according to claim 1, wherein said punching/stapling means comprises a pair of staplers movable to be interlocked with each other, said pair of staplers being located outside side edges of the recorded sheets in a widthwise direction prior to stapling.

4. An apparatus according to claim 1, wherein said moving mechanism comprises a pair of side plates for regulating widthwise side edges of the recorded sheets so as to be movable in a direction perpendicular to the recorded sheet convey direction.

5. An apparatus according to claim 1, wherein said apparatus is used together with an electrophotographic copying machine, and the set of recorded sheets are discharged from said electrophotographic copying machine.

* * * * *